US009250604B2

(12) United States Patent
Kurimoto et al.

(10) Patent No.: US 9,250,604 B2
(45) Date of Patent: Feb. 2, 2016

(54) IMAGE FORMING APPARATUS WITH HIGH-AND LOW-FREQUENCY WORKING SECTIONS

(71) Applicant: Sharp Kabushiki Kaisha, Osaka (JP)

(72) Inventors: Naoaki Kurimoto, Osaka (JP); Kuniaki Nakano, Osaka (JP); Hiroshi Kubota, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/416,161

(22) PCT Filed: Jul. 17, 2013

(86) PCT No.: PCT/JP2013/069420
§ 371 (c)(1),
(2) Date: Jan. 21, 2015

(87) PCT Pub. No.: WO2014/017358
PCT Pub. Date: Jan. 30, 2014

(65) Prior Publication Data

US 2015/0185692 A1 Jul. 2, 2015

(30) Foreign Application Priority Data

Jul. 24, 2012 (JP) ..... 2012-163952
Jul. 24, 2012 (JP) ..... 2012-163953

(51) Int. Cl.
*G03G 15/00* (2006.01)
*G03G 21/18* (2006.01)
*G03G 21/16* (2006.01)

(52) U.S. Cl.
CPC ..... *G03G 21/181* (2013.01); *G03G 21/1604* (2013.01); *G03G 21/1619* (2013.01); *G03G 21/1633* (2013.01)

(58) Field of Classification Search
CPC ..... G03G 21/181
USPC ..... 399/110
See application file for complete search history.

(56) References Cited

U.S. PATENT DOCUMENTS 4,958,823 A * 9/1990 Iwaki et al.
5,594,535 A * 1/1997 Beaufort et al.

(Continued)

FOREIGN PATENT DOCUMENTS

JP 07-325444 A 12/1995
JP 2007-219454 A 8/2007

(Continued)

OTHER PUBLICATIONS

International Search Report for corresponding International Application No. PCT/JP2013/069420 mailed Oct. 8, 2013.

(Continued)

*Primary Examiner* — Susan Lee
(74) *Attorney, Agent, or Firm* — Renner, Otto, Boisselle & Sklar, LLP

(57) ABSTRACT

An image forming apparatus (1) includes, as working sections, a paper output tray (16), a paper feeding cassette (13), and attachment sections to which toner cartridges (71) through (74), a waste toner container (69), and a unit assembly (11) are attached. Out of the working sections, a high-frequency working section with a high working frequency is provided on a front surface of the image forming apparatus, and a low-frequency working section with a low working frequency is provided on a side surface of the image forming apparatus.

5 Claims, 20 Drawing Sheets

(56) References Cited

U.S. PATENT DOCUMENTS

| | | | | |
|---|---|---|---|---|
| 6,738,590 | B2 * | 5/2004 | Okimura et al. | |
| 8,047,529 | B2 * | 11/2011 | Fukasawa | |
| 2006/0218431 | A1 * | 9/2006 | Tanaka et al. | |
| 2007/0196148 | A1 | 8/2007 | Shishikura | |
| 2007/0286649 | A1 | 12/2007 | Kawasumi et al. | |
| 2008/0080902 | A1 | 4/2008 | Saito et al. | |
| 2008/0226339 | A1 | 9/2008 | Sato | |
| 2008/0310882 | A1 | 12/2008 | Kato et al. | |
| 2009/0086243 | A1 * | 4/2009 | Yamazaki | |
| 2009/0274483 | A1 * | 11/2009 | Kim | 399/110 |
| 2010/0302569 | A1 | 12/2010 | Enami et al. | |
| 2011/0110688 | A1 * | 5/2011 | Takigawa | |

FOREIGN PATENT DOCUMENTS

| | | | |
|---|---|---|---|
| JP | 2007-304500 | A | 11/2007 |
| JP | 2008-090048 | A | 4/2008 |
| JP | 2008-216451 | A | 9/2008 |
| JP | 2008-310120 | A | 12/2008 |
| JP | 2010-060602 | A | 3/2010 |
| JP | 2011-008230 | A | 1/2011 |
| JP | 2011-053528 | A | 3/2011 |

OTHER PUBLICATIONS

Form PCT/ISA/237 for corresponding International Application No. PCT/JP2013/069420 dated Oct. 8, 2013.

* cited by examiner

FIG. 19

( FIRST AND SECOND EXAMPLES OF SIDE SURFACE OPENING/CLOSING DOOR )

| TARGET TO BE REPLACED/SUPPLIED | WORKING POSITION OF WORKER | OPENING DEGREE OF OPENING DOOR | DIFFICULTY IN WORKING OPERATION |
|---|---|---|---|
| SUPPLY OF PAPER | FRONT SURFACE OF APPARATUS | OPENING IS UNNECESSARY | LOW |
| COLLECTION OF PRINTED PAPER | FRONT SURFACE OF APPARATUS | OPENING IS UNNECESSARY | LOW |
| TONER CARTRIDGE | FRONT SURFACE SIDE POSITION | FIRST OPENING POSITION (OPENING DEGREE IS LOW) | MODERATE |
| WASTE TONER CONTAINER | FRONT SURFACE SIDE POSITION | SECOND OPENING POSITION (OPENING DEGREE IS HIGH) | MODERATE |
| UNIT ASSEMBLY | RIGHT SURFACE OR FRONT SURFACE (ROTATE APPARATUS BY 90° ) | SECOND OPENING POSITION (OPENING DEGREE IS HIGH) | HIGH |

FIG. 20

( THIRD EXAMPLE OF SIDE SURFACE OPENING DOOR )

| TARGET TO BE REPLACED/SUPPLIED | WORKING POSITION OF WORKER | OPENING DEGREE OF OPENING DOOR | DIFFICULTY IN WORKING OPERATION |
|---|---|---|---|
| SUPPLY OF PAPER | FRONT SURFACE OF APPARATUS | OPENING IS UNNECESSARY | LOW |
| COLLECTION OF PRINTED PAPER | FRONT SURFACE OF APPARATUS | OPENING IS UNNECESSARY | LOW |
| TONER CARTRIDGE | FRONT SURFACE SIDE POSITION | FIRST OPENING POSITION (OPENING DEGREE IS LOW) | MODERATE |
| WASTE TONER CONTAINER | FRONT SURFACE SIDE POSITION | SECOND OPENING POSITION (OPENING DEGREE IS MEDIUM) | MODERATE |
| UNIT ASSEMBLY | RIGHT SURFACE OR FRONT SURFACE (ROTATE APPARATUS BY 90° ) | THIRD OPENING POSITION (OPENING DEGREE IS HIGH) | HIGH |

FIG. 21

( RELATION BETWEEN PAPER FEEDING CASSETTE AND UNIT COLLECTIVE MEMBER )

| TARGET | WORKING SURFACE | POSITIONAL RELATION BETWEEN WORKING SURFACES | CLOSE TO/SPACED FROM OPERATOR |
|---|---|---|---|
| PAPER FEEDING CASSETTE | FRONT SURFACE OF APPARATUS | SURFACES ADJACENT TO EACH OTHER | CLOSE TO OPERATOR |
| UNIT ASSEMBLY | SIDE SURFACE OF APPARATUS | | SPACED FROM OPERATOR |

IMAGE FORMING APPARATUS WITH HIGH-AND LOW-FREQUENCY WORKING SECTIONS

TECHNICAL FIELD

The present invention relates to an image forming apparatus which includes a toner cartridge and which forms a visible image with use of a toner supplied from the toner cartridge.

Furthermore, the present invention relates to an image forming apparatus which forms a visible image based on image data with use of a developer.

BACKGROUND ART

In an electrophotographic image forming apparatus, a process unit forms an electrostatic latent image corresponding to an image to be printed, and makes the electrostatic latent image visible. Specifically, the process unit includes a photoreceptor and a developing device, and forms an electrostatic latent image on the photoreceptor and develops the electrostatic latent image (makes the electrostatic latent image visible) with use of a toner supplied from the developing device. A toner image formed on a surface of the photoreceptor by development is transferred onto, for example, a transfer belt, and the toner image is transferred from the transfer belt onto paper, and thereafter fixed onto the paper by a fixing device.

Furthermore, in the image forming apparatus, in a case where a toner in the developing device is consumed by development, a toner is appropriately supplied from a toner cartridge to the developing device. The toner cartridge is replaced with new one when no toner remains in the toner cartridge. Similarly, the process unit is replaced with new one when, for example, a predetermined number of sheets of paper have been printed.

Image forming apparatuses used in small offices and home offices have been downsized and designed to occupy a smaller space. On the other hand, in small offices and home offices, document files, books, bookshelves, cabinets, etc. are provided on sides of the image forming apparatuses in many cases. This makes it difficult to secure spaces on the sides of the image forming apparatuses. For this reason, such an image forming apparatus is mainly configured such that a worker can replace a toner cartridge, a process unit, etc. at a position in front of the image forming apparatus.

In a case where an image forming apparatus is configured such that a worker handles a toner cartridge while opening a front door of the image forming apparatus, it is necessary to provide a working space for the worker in front of the image forming apparatus. However, in small offices and home offices, there are many cases where a sufficient working space cannot be secured even in front of an image forming apparatus. Examples of such cases include a case where a worker's movement in forward and backward directions in front of the image forming apparatus blocks other person's passage. This is likely to make a smooth working operation difficult.

One possible solution to this problem is to provide a side surface of the image forming apparatus with a door for a working operation, so that a worker can handle a toner cartridge etc. at a position in front of the image forming apparatus.

For example, Patent Literature 1 describes an image forming apparatus having, on a side surface thereof, an openable cover which opens backward. A cartridge holder is provided at an inner surface of the openable cover. A toner cartridge can be inserted into and drawn out from the cartridge holder in obliquely forward and backward directions. Furthermore, a toner cartridge can be attached to a predetermined position of the image forming apparatus by closing the openable cover.

Patent Literature 2 describes an image forming apparatus having, at a side surface thereof, a side cover which opens downward and which has a cartridge storage section. A toner cartridge can be inserted into and drawn out from the cartridge storage section in obliquely upward and downward directions while the side cover is open. Furthermore, a toner cartridge can be attached to a predetermined position of the image forming apparatus by closing the side cover.

In response to a demand from a market, electrophotographic apparatuses of a color output type have come to occupy a larger part of whole electrophotographic apparatuses. In particular, recently, since a processing speed for a color output has been required to be as high as that for a monochrome output, color image forming apparatuses of a tandem type including photoreceptors and developing devices for respective colors have become dominant. In such a color image forming apparatus, monochrome toner images are formed on respective photoreceptors, and these monochrome toner images are sequentially superimposed so as to form a color image on paper. There are two types of a color image forming apparatus of a tandem type: one which sequentially superimposes four color toner images directly on paper so as to transfer the color toner images; and one which temporarily and sequentially superimposes four color toner images on an intermediate transfer member and then transfers a resulting image on paper.

On the other hand, with advance of technology, large multicolor image forming apparatuses are tend to be avoided, and image forming apparatuses so downsized as to be provided on a desktop PC rack etc. are coming into practical use. However, such downsizing of an image forming apparatus complicates a structure within the apparatus. This easily causes difficulty in a maintenance operation.

In consideration of downsizing of an image forming apparatus and workability in a replacement operation of image forming units, it is advantageous to integrate a plurality of image forming units. For this reason, a configuration often employed is such that in each of a plurality of (four or three) image forming sections provided inside an image forming apparatus, a photoreceptor drum, a cleaning unit, a charger, a developer, etc. are integrated so that each of the plurality of image forming sections becomes an image forming unit which is detachable from the image forming apparatus.

Such an image forming apparatus is promoted to be downsized and to occupy a smaller space in order to be usable in a SOHO (small office, home office) environment. However, in the SOHO environment, it is particularly difficult to secure a space on a side of the image forming apparatus. For this reason, a dominant type of the image forming apparatus is one in which a worker can exchange a toner cartridge, a process unit, etc. from a position in front of the image forming apparatus.

In the image forming apparatus described in Patent Literature 2, a toner cartridge is attached/detached for replacement thereof while a side cover supported by a hinge at a lower part of the side cover is opened. Furthermore, a process unit is attached or detached while a front cover supported by a hinge at a lower part thereof is opened. A paper feeding tray is attached to/detached from a tray-containing section by sliding the paper feeding tray in forward and backward directions from a front of the apparatus.

In the image forming apparatus described in Patent Literature 1, while an openable cover supported by a longitudinal hinge at a right side wall of the image forming apparatus is opened in a backward direction of the image forming apparatus, an image forming unit integrated as a replacement unit is attached/detached and a toner cartridge is attached/detached to/from the image forming unit accompanied by replacement of a toner cartridge. Although a paper tray is described as a part of a paper feeding device, Patent Literature 1 does not clearly describe a direction in which the above attachment/detachment is carried out.

In an image forming apparatus described in Patent Literature 3, an image forming unit and an intermediate transfer member are integrally formed as an indirect transfer unit, and the indirect transfer unit is detachable from the image forming apparatus. Patent Literature 3 does not clearly describe how a cover, door, etc. which open when the indirect transfer unit is attached/detached are supported and in what directions the cover, door, etc. open. Further, Patent Literature 3 does not clearly describe in what direction a paper feeding tray is attached/detached.

CITATION LIST

Patent Literatures

[Patent Literature 1]
Japanese Patent Application Publication No. 2008-090048 (published on Apr. 17, 2008)
[Patent Literature 2]
Japanese Patent Application Publication No. 2008-216451 (published on Sep. 18, 2008)
[Patent Literature 3]
Japanese Patent Application Publication No. 2011-008230 (published on Jan. 13, 2011)

SUMMARY OF INVENTION

Technical Problem

According to the configurations described in Patent Literatures 1 and 2, in a case where a relatively small space which allows opening a door on a side surface of an image forming apparatus can be provided on a side of the image forming apparatus, a worker who is replacing a toner cartridge is not required to move in forward and backward directions at a position in front of the image forming apparatus, so that a toner cartridge can be replaced in a small working space. Therefore, the configurations described in Patent Literatures 1 and 2 are excellent in that a toner cartridge can be replaced in a small working space.

However, an image forming apparatus requires not only replacement of a toner cartridge which is a consumable article, but also supply of supplies such as paper, and at least replacement of a process unit (image forming unit).

Frequency in supply of supplies, frequency in replacement of a consumable article, and frequency in replacement of a process unit are different from one another. Accordingly, if working positions for supply of supplies, replacement of a consumable article, and replacement of a process unit are set in an image forming apparatus with no consideration for the frequency in supply and the frequency in replacement, a worker cannot smoothly carry out the supply operation and the replacement operation, so that the image forming apparatus has poor workability.

Therefore, a first object of the present invention is to provide an image forming apparatus which has excellent workability in whole operations with respect to the image forming apparatus, such as a supply operation of supplies, a replacement operation of a consumable article, and a replacement operation of an image forming unit.

In the image forming apparatus described in Patent Literature 2, a process unit and a paper feeding tray are attached/detached in the same surface in the same direction. Besides, a position where the process unit is attached/detached is above a position where the paper feeding tray is attached/detached. Consequently, there is a possibility that a scattered toner etc. drops on a paper etc. when a process unit is attached/detached, so that the paper is stained. This also applies to the image forming apparatus described in Patent Literature 3.

As regards the image forming apparatus described in Patent Literature 1, although Patent Literature 1 does not clearly describe a direction in which a paper feeding tray is attached/detached and a surface where the paper feeding tray is attached/detached, a possible configuration is such that the paper feeding tray is attached/detached on a backside of the apparatus or on a left side of the apparatus when the apparatus is seen from a worker. Consequently, the worker who wants to attach/detach a paper feeding tray is required to go to the backside of the apparatus or to a side opposite to a side where the image forming unit and the toner cartridge are attached/detached. This causes deterioration in workability in attachment/detachment of the paper feeding tray and attachment/detachment of the image forming unit.

Therefore, a second object of the present invention is to provide an image forming apparatus capable of preventing paper contained in a paper feeding tray from being stained due to attachment/detachment of an image forming unit, and of enhancing workability in attachment/detachment of units including the image forming unit and in an operation with respect to the paper feeding tray.

Solution to Problem

In order to solve the foregoing problem, an image forming apparatus of the present invention is an image forming apparatus, comprising: a section configured to receive a supply; a component to be replaced; an image forming unit configured to form a toner image; and working sections that are the section configured to receive the supply, an attachment and detachment section configured to replace the component to be replaced, and an attachment and detachment section configured to replace the image forming unit, the working sections being distributed on a front surface and a side surface of the image forming apparatus, out of the working sections, at least one high-frequency working section and at least one low-frequency working section being provided on the front surface and the side surface, respectively, the at least one high-frequency working section being relatively high in working frequency with which a supply operation or a replacement operation is carried out, and the at least one low-frequency working section being relatively low in the working frequency.

Furthermore, in order to solve the foregoing problem, an image forming apparatus of the present invention is an image forming apparatus, in which a plurality of process units including respective photoreceptors and corresponding to respective colors each carry out an electrophotographic process so as to form developer images on the respective photoreceptors, the developer images of the respective colors are transferred from the respective photoreceptors to an intermediate transfer member of an intermediate transfer unit while being overlapped on the intermediate transfer member so as to form a multi-color developer image, and the multi-color developer image is transferred from the intermediate transfer member onto paper, the image forming apparatus comprising a unit assembly including: an image forming unit including the plurality of process units; and the intermediate transfer unit, the image forming apparatus having a front surface and a side surface, one of which is a working surface through which the unit assembly is attached to or detached from the image forming apparatus and the other of which is a working surface through which a paper feeding tray that contains the paper and that is included in the image forming apparatus is inserted into or drawn out from the image forming apparatus, the side surface being adjacent to the front surface.

Advantageous Effects of Invention

With the arrangement, the image forming apparatus has excellent workability in terms of working operations including supply of supplies, replacement of consumable articles, and replacement of the image forming unit.

Furthermore, with the arrangement, even when a toner is scattered from the unit assembly in attachment/detachment of the unit assembly, it is possible to prevent paper in the paper feeding tray from being stained by the scattered toner.

Furthermore, in a case where an operation on the paper feeding tray and attachment/detachment of the unit assembly are carried out at the same time, the paper feeding tray and the unit assembly do not interfere with each other, so that both operations can be carried out smoothly at the same time.

Furthermore, since the working surface for the paper feeding tray and the working surface for the unit assembly are adjacent to each other, a worker who carries out both operations is only required to move a little, resulting in good workability.

Furthermore, although the unit assembly which includes the image forming unit including a plurality of process units and the intermediate transfer unit is larger in size than individual image forming units, the unit assembly allows easily securing a space for attaching/detaching the unit assembly since the unit assembly is attached/detached at a working surface different from the working surface for the paper feeding tray.

Figure 13:
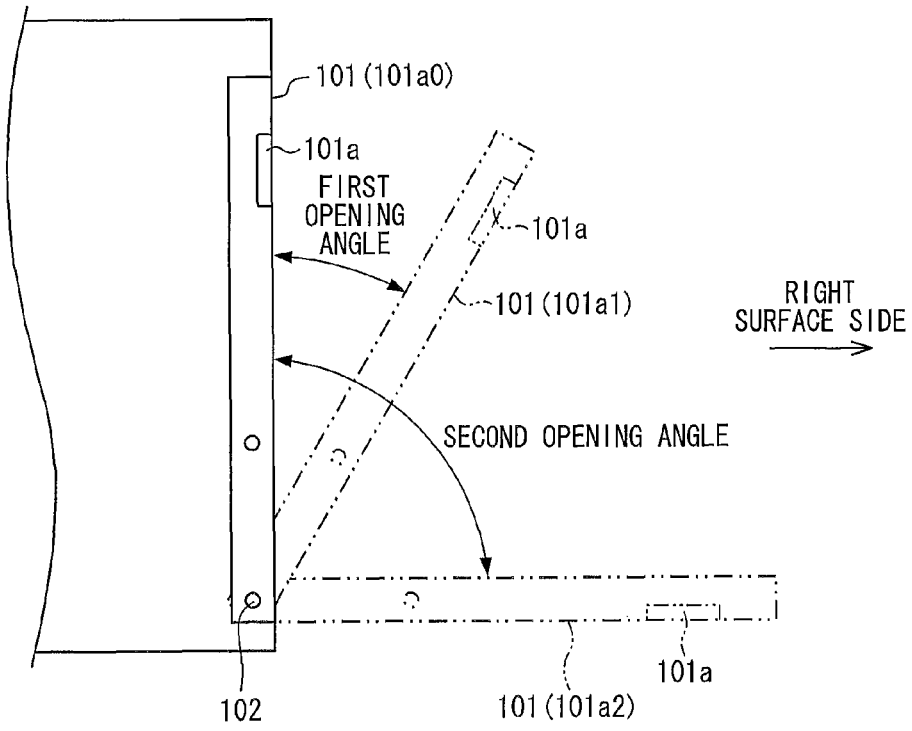
FIG. 13 is an explanatory view illustrating how a side surface opening/closing door is opened and closed in the image forming apparatus main body illustrated in FIG. 4.
Figure 14:
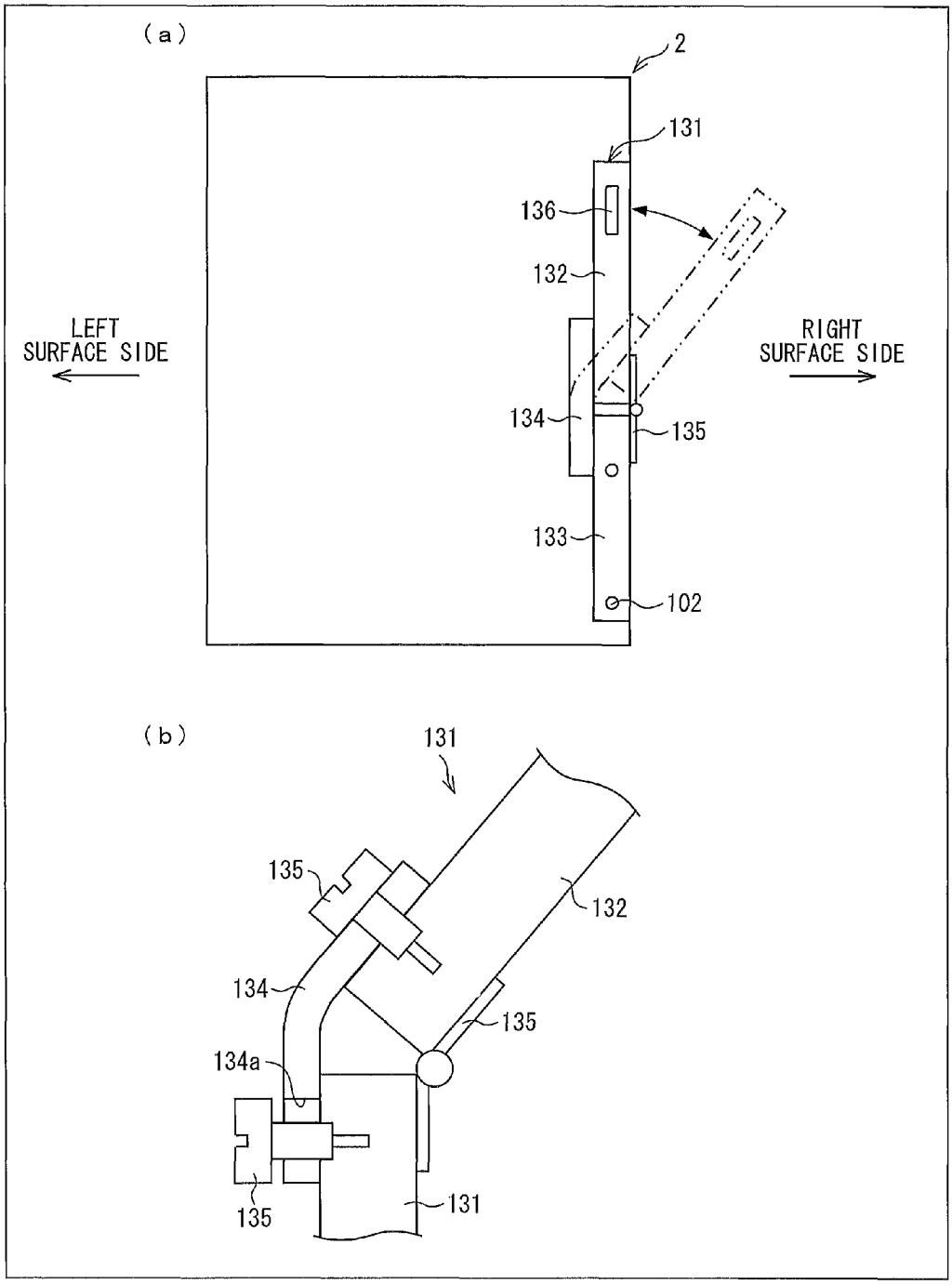

(a) of FIG. 14 is an explanatory view illustrating another example of the side surface opening/closing door illustrated in FIG. 13. (b) of FIG. 14 is an explanatory view illustrating a state where a door upper part of the side surface opening/closing door illustrated in (a) of FIG. 14 is opened.

Figure 15:
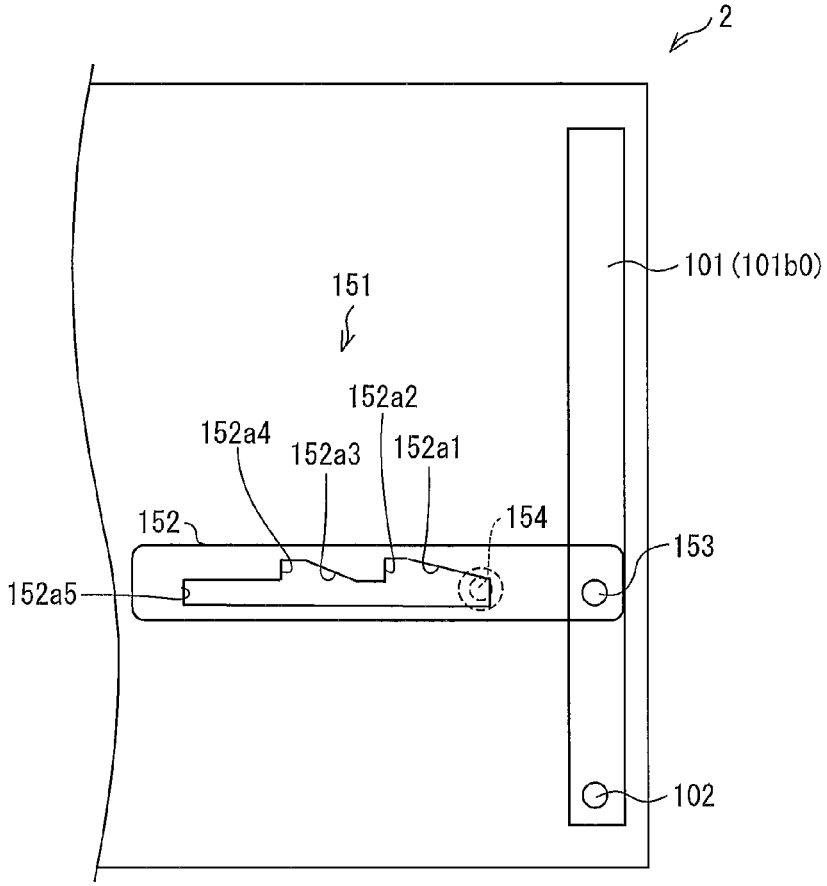

FIG. 15 is an explanatory view illustrating a state of an opening angle adjusting mechanism section in a case where the side surface opening/closing door is at a closing position in an image forming apparatus main body in accordance with another embodiment of the present invention.

Figure 16:
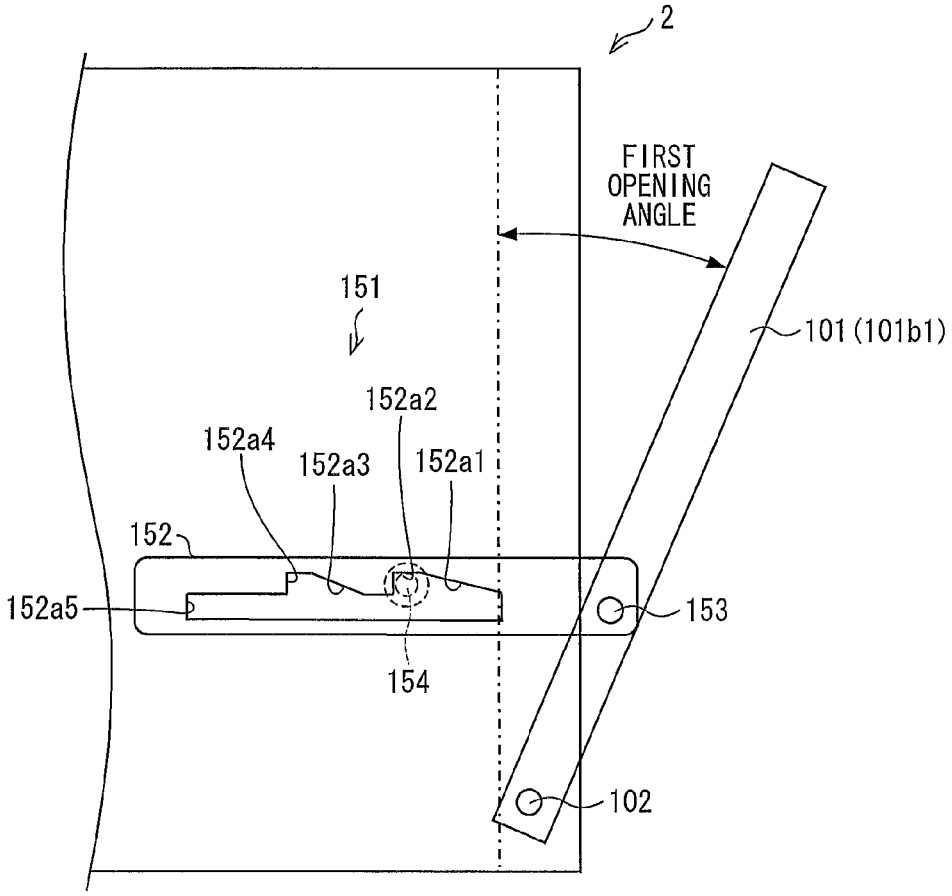

FIG. 16 is an explanatory view illustrating a state of the opening angle adjusting mechanism section in a case where the side surface opening/closing door illustrated in FIG. 15 is at a first opening position.

Figure 17:
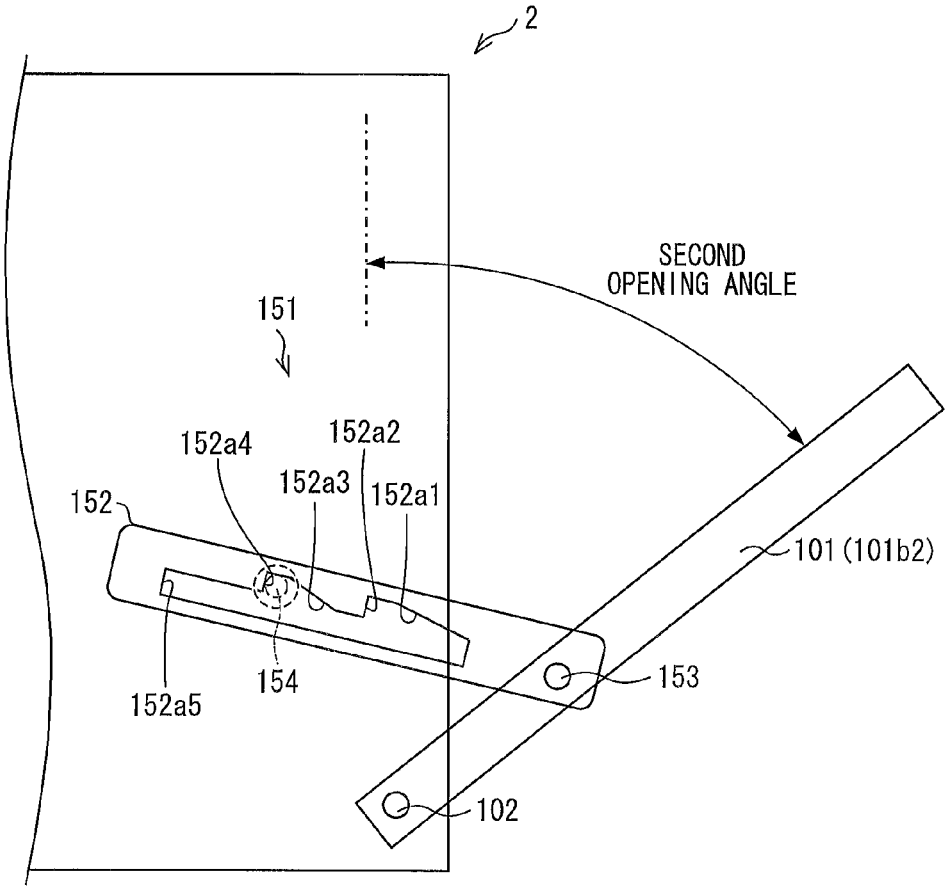

FIG. 17 is an explanatory view illustrating a state of the opening angle adjusting mechanism section in a case where the side surface opening/closing door illustrated in FIG. 15 is at a second opening position.

Figure 18:
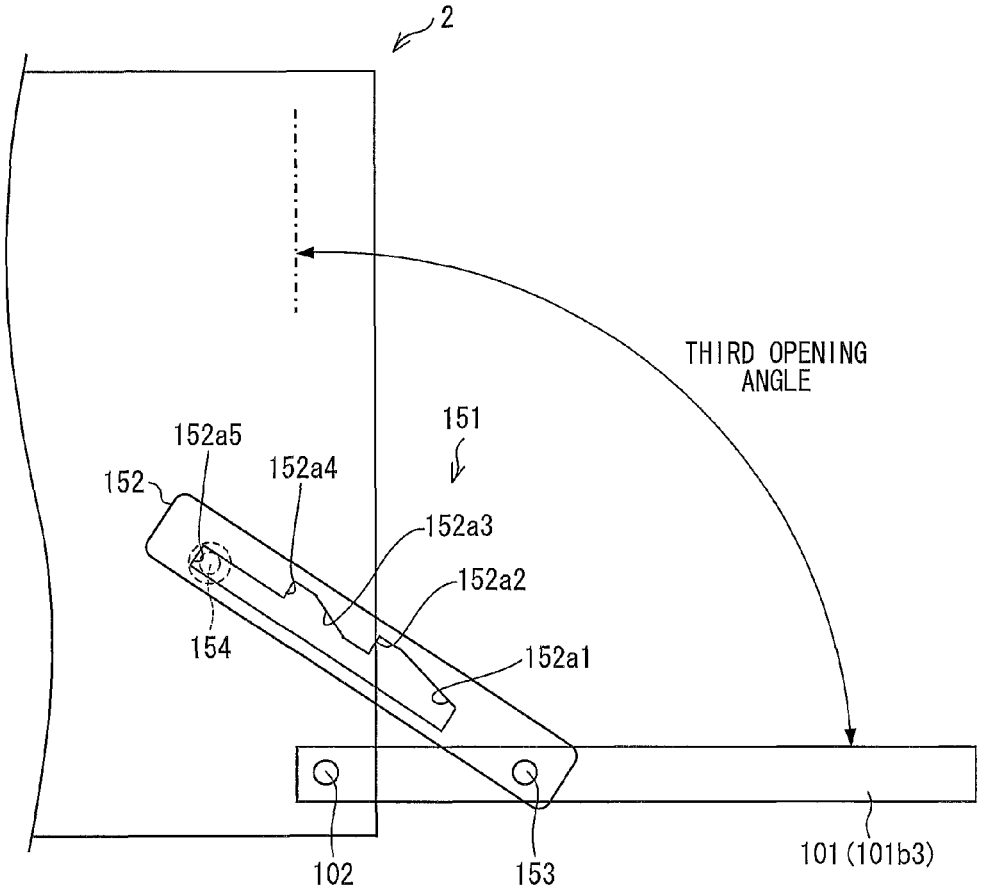

FIG. 18 is an explanatory view illustrating a state of the opening angle adjusting mechanism section in a case where the side surface opening/closing door illustrated in FIG. 15 is at a third opening position.

FIG. 19 is an explanatory view illustrating a relation among each target to be replaced or supplied, a working position of a worker with respect to the image forming apparatus, an opening degree of the side surface opening/closing door, and difficulty in the working operation, in cases where the image forming apparatus in accordance with the embodiment of the present invention includes the side surface opening/closing door of the first example and where the image forming apparatus in accordance with the embodiment of the present invention includes the side surface opening/closing door of the second example.

FIG. 20 is an explanatory view illustrating a relation among each target to be replaced or supplied, a working position of a worker with respect to the image forming apparatus, an opening degree of the side surface opening/closing door, and difficulty in the working operation, in a case where the image forming apparatus in accordance with the embodiment of the present invention includes the side surface opening/closing door of the third example.

Figure 1:
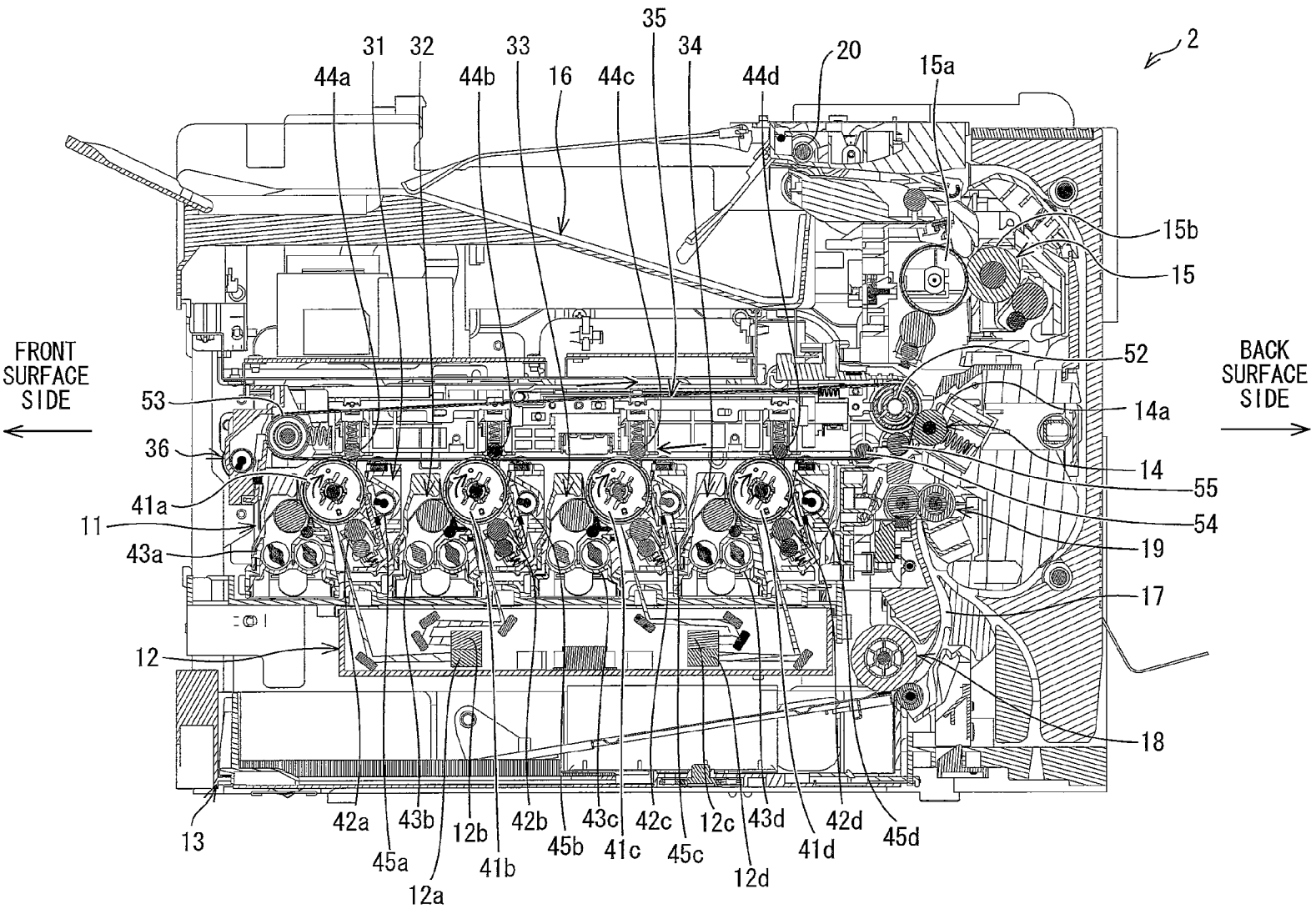
FIG. 1 is a longitudinal cross sectional view illustrating an internal structure of an image forming apparatus main body in accordance with an embodiment of the present invention, when seen from a right surface side of the image forming apparatus main body.

FIG. 21 is an explanatory view illustrating a relation between the paper feeding cassette and the unit assembly which are illustrated in FIG. 1.

DESCRIPTION OF EMBODIMENTS

[First Embodiment]

(Whole Configuration of Image Forming Apparatus)

The following description will discuss an embodiment of the present invention with reference to FIGS. 1 through 20. Hereinafter, a surface on a right side of an image forming apparatus which is seen from a front thereof is referred to as a right surface of the image forming apparatus, and a surface on a left side of the image forming apparatus which is seen from the front thereof is referred to as a left surface of the image forming apparatus.

An image forming apparatus in accordance with the present invention is constituted by an image forming apparatus main body and an automatic document feeder thereon. FIG. 1 is a longitudinal cross sectional view illustrating an internal structure of an image forming apparatus main body 2 which is seen from a right surface side thereof. A left side of FIG. 1 is equal to a front surface side of the image forming apparatus main body 2, and a right side of FIG. 1 is equal to a backside of the image forming apparatus main body 2.

In the present embodiment, the image forming apparatus main body 2 is a full-color printer. Accordingly, the image forming apparatus main body 2 prints a color image on paper (sheet of recording medium) in accordance with image data supplied from outside. Here, the image forming apparatus main body 2 is a printer for example. However, the image forming apparatus main body 2 may be a copying machine, a facsimile machine, or a multifunction printer having a copying function and/or a facsimile function. In this case, the image forming apparatus main body 2 prints a multi-color image or a monochrome image on paper in accordance with image data supplied from outside and/or image data read out from a document by a scanner.

As illustrated in FIG. 1, the image forming apparatus main body 2 includes a unit assembly (component to be replaced) 11 at a central part in upward and downward directions. At a position under the unit assembly 11, a laser optical system unit 12 and a paper feeding cassette (paper feeding section, section for receiving a supply) 13 are provided in this order from the above. Furthermore, a transfer section 14 is provided at a backside of the unit assembly 11, and a fixing section 15 is provided above the transfer section 14. An upper surface of a housing of the image forming apparatus main body 2 which surface is above the unit assembly 11 serves as a paper output tray (paper output section) 16.

A paper carrying path 17 is provided at a path extending from the paper feeding cassette 13 to the paper output tray 16. The paper carrying path 17 is provided with a paper feeding roller 18, a timing roller 19, the transfer section 14, the fixing section 15, and a paper output roller 20 in this order from the paper feeding cassette 13 toward the paper output tray 16.

First to fourth image forming sections 31 to 34 included in the unit assembly 11 are for yellow, magenta, cyan, and black, respectively.

The image forming section 31 includes a photoreceptor drum 41*a*, a charging device 42*a*, a developing device 43*a*, an intermediate transfer roller 44*a*, and a photoreceptor cleaning device 45*a*.

The charging device 42*a* charges a surface of the photoreceptor drum 41*a* so that the surface has a predetermined potential. The developing device 43*a* develops, by using a toner, an electrostatic latent image which was formed on the surface of the photoreceptor drum 41*a* when the photoreceptor drum 41*a* was exposed to laser light from the laser optical system unit 12. The intermediate transfer roller 44*a* is provided at a back surface of the intermediate transfer belt 51, and transfers a toner image, which has been formed on the surface of the photoreceptor drum 41*a* as a result of the development, to a front surface of an intermediate transfer belt 61 of an intermediate transfer belt unit 35. After the development and the transfer of the toner image, the photoreceptor cleaning device 45*a* removes and collects a remaining toner and paper powder on the surface of the photoreceptor drum 41*a*.

Similarly, the second image forming section 32 includes a photoreceptor drum 41*b*, a charging device 42*b*, a developing device 43*b*, an intermediate transfer roller 44*b*, and a photoreceptor cleaning device 45*a*. The third image forming section 33 includes a photoreceptor drum 41*c*, a charging device 42*c*, a developing device 43*c*, an intermediate transfer roller 44*c*, and a photoreceptor cleaning device 45*c*. The fourth image forming section 34 includes a photoreceptor drum 41*d*, a charging device 42*d*, a developing device 43*d*, an intermediate transfer roller 44*d*, and a photoreceptor cleaning device 45*d*.

The intermediate transfer belt unit 35 includes the intermediate transfer belt 51, a driving roller 52 for supporting the intermediate transfer belt 51, a driven roller 53, and tension rollers 54 and 55.

A transfer belt cleaning device 36 removes a remaining toner and paper powder on the surface of the intermediate transfer belt 51.

The laser optical system unit 12 includes laser light sources 12*a* to 12*d* corresponding to the photoreceptor drums 41*a* to 41*d*, respectively. The laser light sources 12*a* to 12*d* radiate laser lights to the photoreceptor drums 41*a* to 41*d*, respectively, so as to form, on surfaces of the photoreceptor drums 41*a* to 41*d*, electrostatic latent images corresponding to an image to be printed by the image forming apparatus main body 2.

The transfer section 14 includes a transfer roller 14*a* to be pressed to the driving roller 52 of the intermediate transfer belt unit 35 via the intermediate transfer belt 51. The transfer section 14 transfers the toner image on the front surface of the intermediate transfer belt 51 to paper supplied from the paper feeding cassette 13.

The fixing section 15 includes a fixing roller 15*a* and a pressure roller 15*b*, and fixes the toner image onto the paper by melting the toner image.

(Image Forming Operation)

In the image forming apparatus main body 2, in printing a color image, the laser optical system unit 12 radiates laser lights to the photoreceptor drums 41*a* to 41*d* in accordance with input image data, and electrostatic latent images are formed on the photoreceptor drums 41*a* to 41*d*, respectively. The electrostatic latent images thus formed are developed by using toners supplied from the developing devices 43*a* to 43*d*, so that a yellow toner image, a magenta toner image, a cyan toner image, and a black toner image are formed on the surfaces of the photoreceptor drums 41*a* to 41*d*, respectively. The toner images are transferred to the same position on the intermediate transfer belt 51 of the intermediate transfer belt unit 35 in such a manner that the toner images are sequentially superimposed, and a resulting toner image is transferred onto paper by the transfer section 14.

The paper is sent from the paper feeding cassette 13 to the paper carrying path 17 by the paper feeding roller 18, and is supplied by the timing roller 19 to the transfer section 14 at timing when the paper matches the toner image on the intermediate transfer belt 51.

The paper onto which the toner image has been transferred by the transfer section 14 is carried to the fixing section 15, and the fixing section 15 fixes the toner image onto the paper. Thereafter, the paper is outputted onto the paper output tray 16 by the paper output roller 20.

Since the fixing section 15 of the image forming apparatus 1 is positioned at a backside thereof, heat (hot wind) generated at the fixing section 15 is not conveyed to a user in front of the image forming apparatus 1, so that the user does not feel uncomfortable.

(Paper Feeding Cassette)

Figure 2:
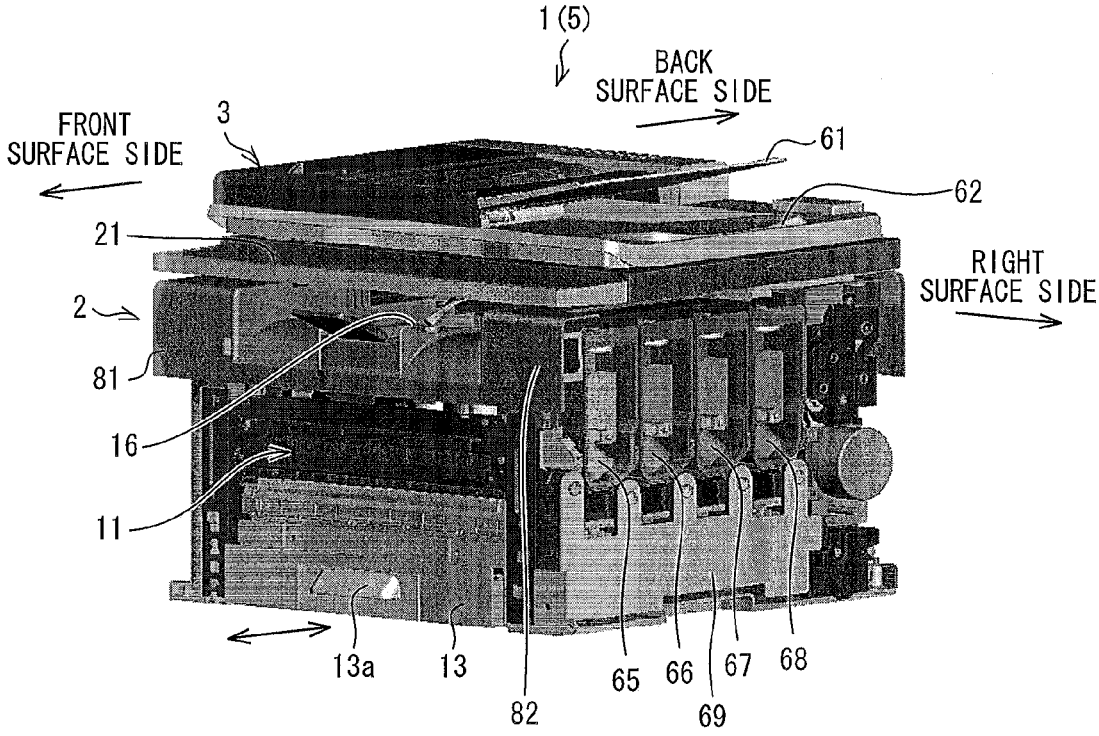
FIG. 2 is a perspective view of an image forming apparatus in accordance with the embodiment of the present invention, which includes an automatic document feeder and from which a housing has been removed.

FIG. 2 is a perspective view of an image forming apparatus 1 in accordance with the embodiment of the present invention, which includes an automatic document feeder 3 and from which a housing has been removed.

The paper feeding cassette 13 illustrated in FIG. 2 can be drawn out toward a front surface side of the image forming apparatus 1 (image forming apparatus main body 2) by pulling a handle 13*a*. The image forming apparatus 1 has an operation panel 21 in an upper part on the front surface side thereof.

(Toner Cartridge)

As illustrated in FIG. 2, at a right surface side of the image forming apparatus main body 2, four cartridge attachment sections 65 through 68 are positioned above the unit assembly 11, and the waste toner container (component to be replaced) 69 is positioned below the unit assembly 11. The cartridge attachment sections 65 through each have a longitudinal shape in upward and downward directions, and are aligned on the same height in forward and backward directions of the image forming apparatus 1. The cartridge attachment sections 65 through 68 form a structure in which adjacent cartridge attachment sections are combined with each other. The cartridge attachment sections 65 through 68 are provided so as to correspond to the developing devices 43*a* through 43*d*, respectively.

Figure 3:
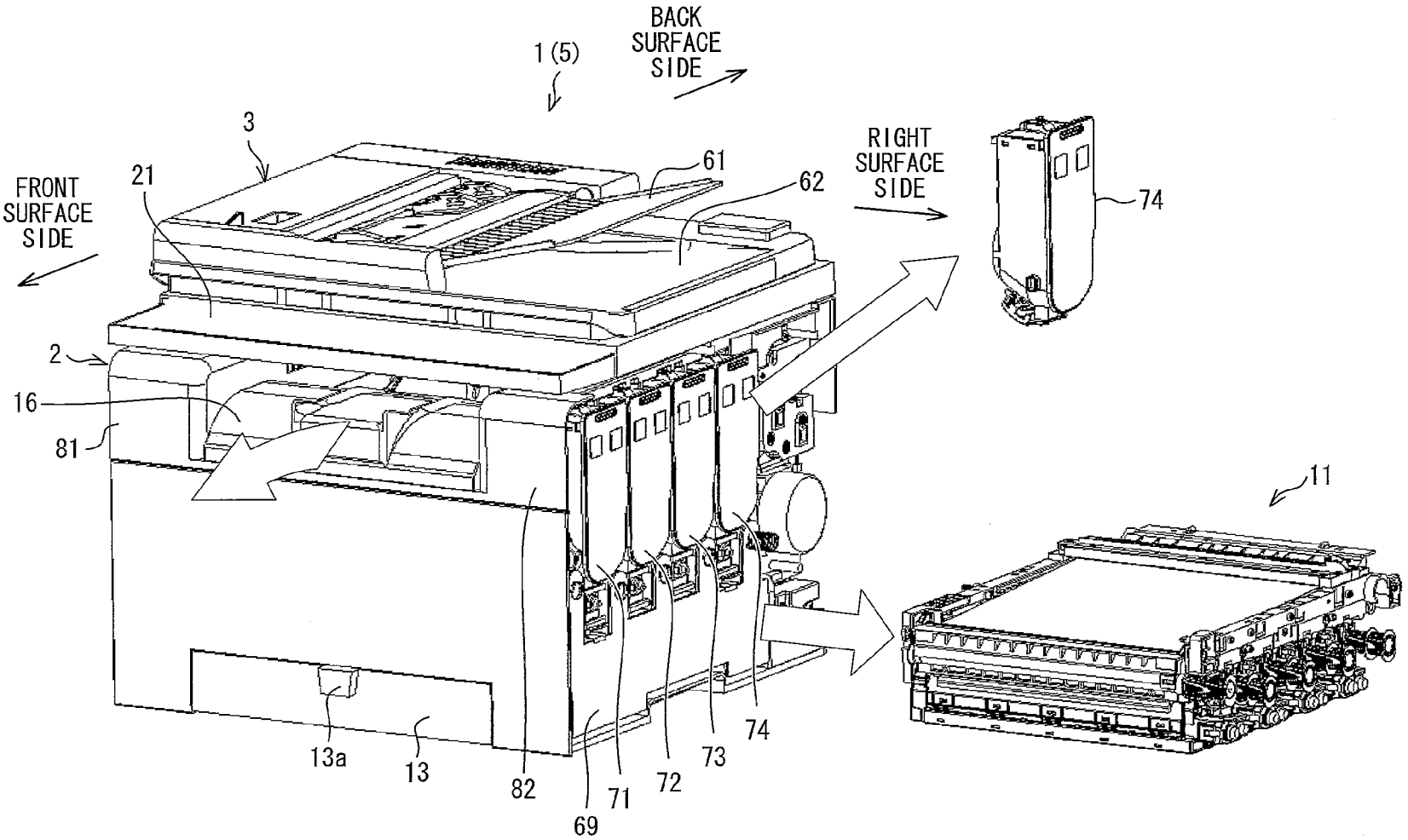
FIG. 3 is a perspective view of the image forming apparatus in which toner cartridges are respectively attached to the cartridge attachment sections illustrated in FIG. 2.
Figure 4:
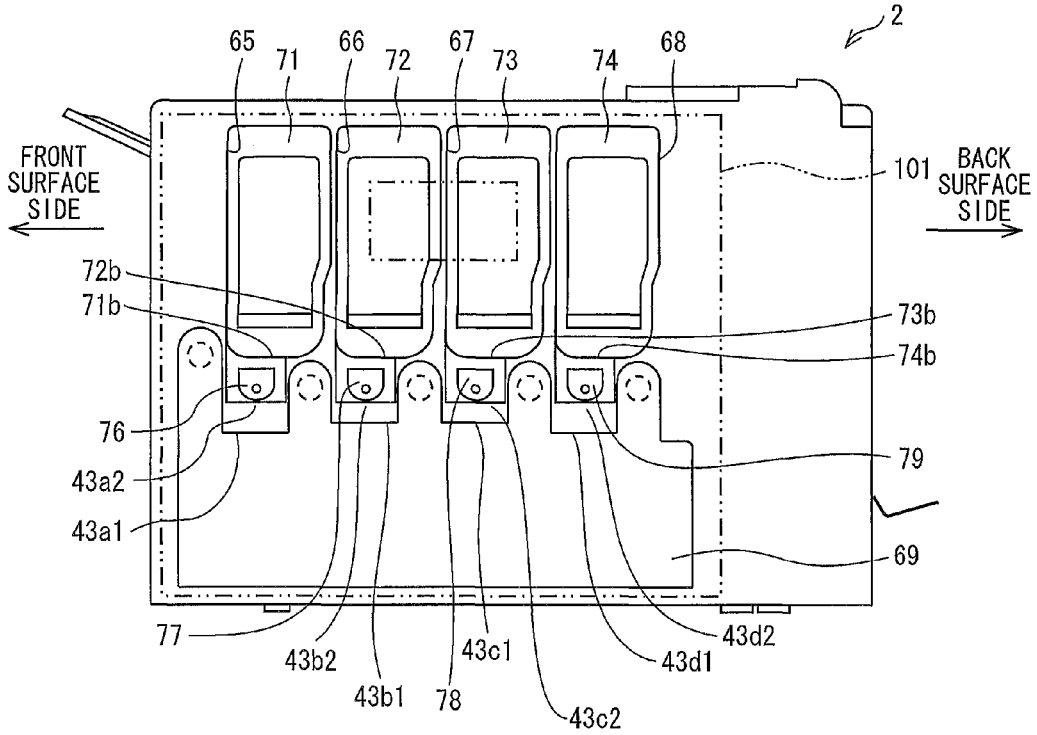
FIG. 4 is an elevation view of the image forming apparatus main body in which toner cartridges are respectively attached to the cartridge attachment sections illustrated in FIG. 2, when seen from the right surface side of the image forming apparatus main body.

As illustrated in FIGS. 3 and 4, toner cartridges (components to be replaced) 71 through 74 are attached to the cartridge attachment sections 65 through 68, respectively. FIG. 3 is a perspective view of the image forming apparatus 1 in which the toner cartridges 71 through 74 are attached to the cartridge attachment sections 65 through 68, respectively, which are illustrated in FIG. 2. FIG. 4 is an elevation view of the image forming apparatus main body 2 in which the toner cartridges 71 through 74 are attached to the cartridge attachment sections 65 through 68, respectively, which are illustrated in FIG. 3, when seen from the right surface side of the image forming apparatus main body 2.

The toner cartridges 71 through 74 contain a yellow toner, a magenta toner, a cyan toner, and a black toner, respectively. The toner cartridges 71 through 74 can supply the respective toners to the corresponding developing devices 43*a* through 43*d* while being attached to the cartridge attachment sections 65 through 68, respectively. The toner cartridges 71 through 74, which form a group, are provided on the right surface side of the image forming apparatus main body 2 in such a way that the toner cartridges 71 through 74 are closer to the front surface of the image forming apparatus main body 2 with respect to a center of the image forming apparatus main body 2 in forward and backward directions.

(Detailed Structures of Toner Cartridge and Cartridge Attachment Section)

Figure 5:
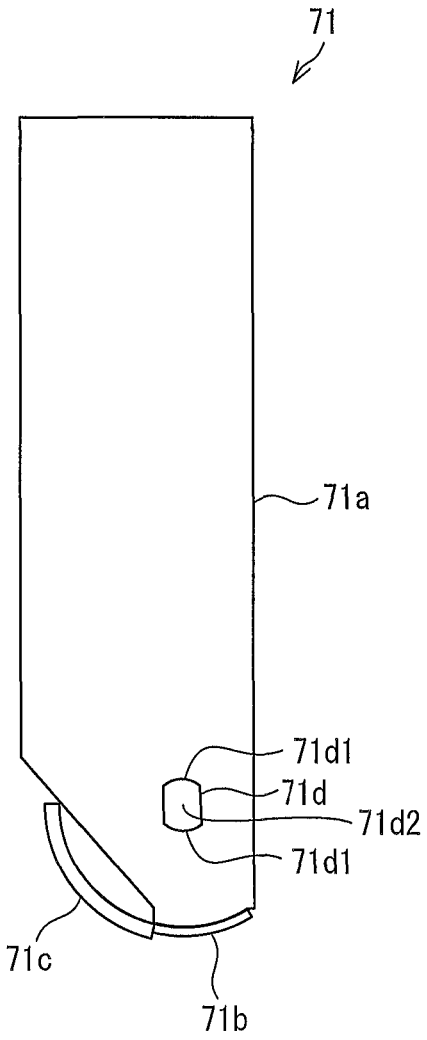
FIG. 5 is a side view illustrating, in a simplified manner, the toner cartridge illustrated in FIG. 4.
Figure 6:
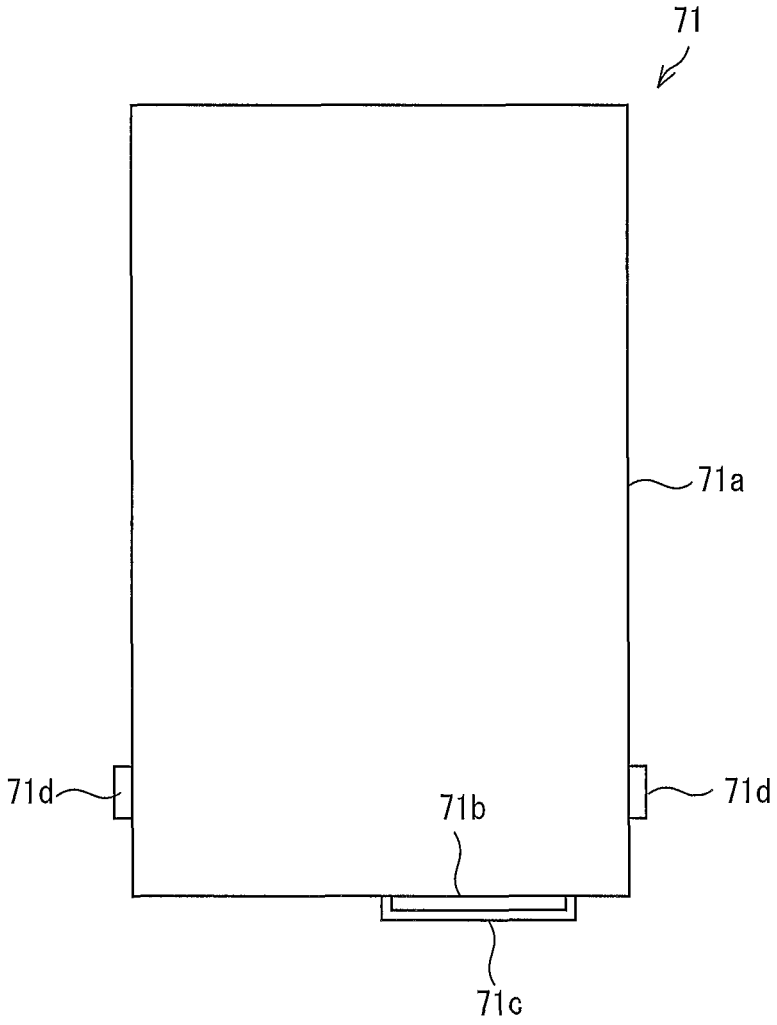
FIG. 6 is an elevation view of the toner cartridge illustrated in FIG. 5.
Figure 7:
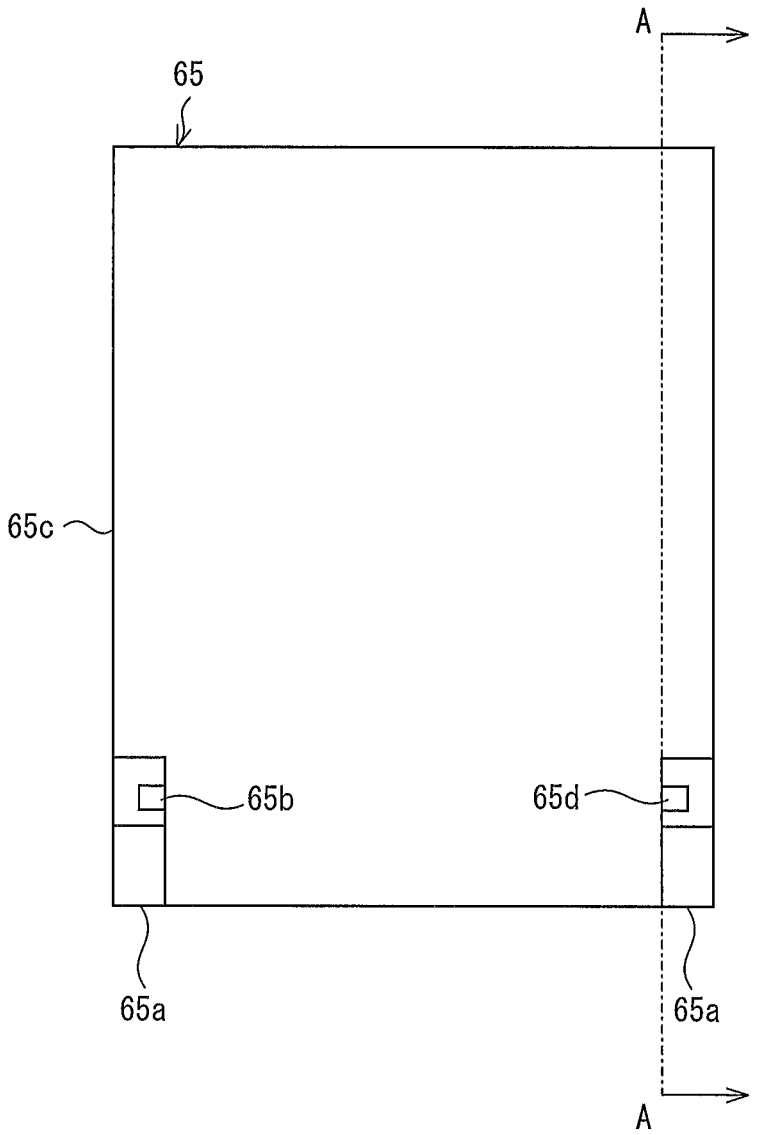
FIG. 7 is an elevation view illustrating, in a simplified manner, the cartridge attachment section illustrated in FIG. 2.
Figure 8:
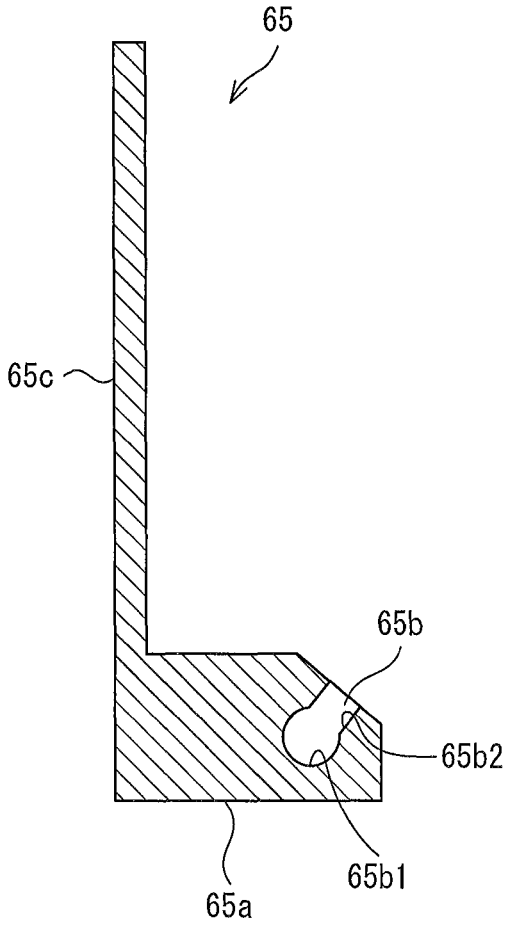
FIG. 8 is a cross sectional view of the cartridge attachment section taken along a line A-A of FIG. 7.

Next, the following description will discuss structures of the toner cartridges 71 through 74 and the cartridge attachment sections 65 through 68. The following description will take the toner cartridge 71 and the cartridge attachment section 65 as examples. FIG. 5 is a side view illustrating, in a simplified manner, the toner cartridge 71 illustrated in FIG. 4. FIG. 6 is an elevation view of the toner cartridge 71 illustrated in FIG. 5, FIG. 7 is an elevation view illustrating, in a simplified manner, the cartridge attachment section 65 illustrated in FIG. 2, and FIG. 8 is a cross sectional view of the cartridge attachment section 65 taken along a line A-A of FIG. 7.

As illustrated in FIGS. 5 and 6, the toner cartridge 71 has a vertically long shape in upward and downward directions, and includes a toner storing section 71*a* for storing a toner therein. The toner storing section 71*a* has a toner supply opening 71*b* located in a lower end of the toner storing section 71*a*. Further, the toner storing section 71*a* includes a shutter 71*c* for opening and closing the toner supply opening 71*b*. A lower end surface of the toner storing section 71*a* on which surface the toner supply opening 71*b* is provided is curved to have an arc shape, and the shutter 71*c* has an arc shape in accordance with the arc shape of the lower end surface. The shutter 71*c* is closed by a spring (not illustrated) during a normal state where the toner cartridge 71 is not attached to the cartridge attachment section 65.

On both side surfaces of the toner storage section 71*a*, there are provided fitting protrusions 71*d* in such a manner as to be above the toner supply opening 71*b* and at a lower portion of the toner cartridge 71 which portion is close to the toner supply opening 71*b*. Specifically, one of the fitting protrusions 71*d* protrudes in a front direction of the image forming apparatus main body 2, and the other protrudes in a back direction of the image forming apparatus main body 2.

Each of the fitting protrusions 71*d* is designed such that upper and lower surfaces thereof are each a curved surface 71*d*1 having an arc shape, and a portion between the upper and lower curved surfaces 71*d*1 is a straight portion 71*d*2 having a narrower width than a width between the curved surfaces 71*d*1.

As illustrated in FIGS. 7 and 8, the cartridge attachment section 65 includes a cartridge facing section 65*c* provided vertically along a right surface of the image forming apparatus main body 2. Furthermore, the cartridge attachment section 65 includes protruding wall sections 65*a* at right and left positions near a lower end portion of the cartridge facing section 65*c* (a position closer to a front surface of the image forming apparatus main body 2 and a position closer to a back surface of the image forming apparatus main body 2).

The protruding wall sections 65*a* each have a fitting recess 65*b* at inner surfaces thereof which face each other. The fitting recess 65*b* has a straight recess 65*b*2 as an introducing portion and a circular recess 65*b*1 as an end portion ahead of the straight recess 65*b*2. The straight recess 65*b*2 has a width a little wider than a width of the straight portion 71*d*2 of the fitting protrusion 71*d* of the toner cartridge 71, and the circular recess 65*b*1 has a width a little wider than a width between the curved surfaces 71*d*1 of the fitting protrusion 71*d* of the toner cartridge 71. Furthermore, the straight recess 65*b*2 is inclined toward the right surface of the image forming apparatus main body 2 in vertical upward and downward directions.

Therefore, in a case where a worker attaches the toner cartridge 71 to the cartridge attachment section 65, the worker initially moves the toner cartridge 71 obliquely downward from above the cartridge attachment section 65 so as to insert the straight portion 71*d*2 into the straight recess 65*b*2 of the fitting recess 65*b*. Furthermore, the worker moves the toner cartridge 71 obliquely downward until the fitting protrusion 71*d* reaches the circular recess 65*b*1 of the fitting recess 65*b*. Thereafter, the worker rotates the toner cartridge 71 until the toner cartridge 71 contacts the cartridge facing section 65*c* of the cartridge attachment section 65. In this case, the toner cartridge 71 can be rotated smoothly because the fitting protrusion 71*d* is rotatably supported by the circular recess 65*b*1 of the fitting recess 65*b*.

(Supply of Toner from Toner Cartridge to Developing Device)

As illustrated in FIG. 4, intermediary toner-receiving members 76 through 79 are provided below the toner cartridges 71 through 74 attached to the cartridge attachment sections 65 through 68, respectively. Furthermore, toner-capturing sections 43*a*1 through 43*d*1 of the developing devices

43*a* through 43*d* have respective ends which are provided below the intermediary toner-receiving members 76 through 79. Consequently, respective toners of the toner cartridges 71 through 74 are supplied to the corresponding developing devices 43*a* through 43*d* via the intermediary toner-receiving members 76 through 79, respectively.

By taking, as an example, a case of the toner cartridge 71, the cartridge attachment section 65, the intermediary toner-receiving member 76, and the developing device 43*a*, the following description will discuss a configuration for supplying the toner from the toner cartridge 71 to the developing device 43*a*.

Figure 9:
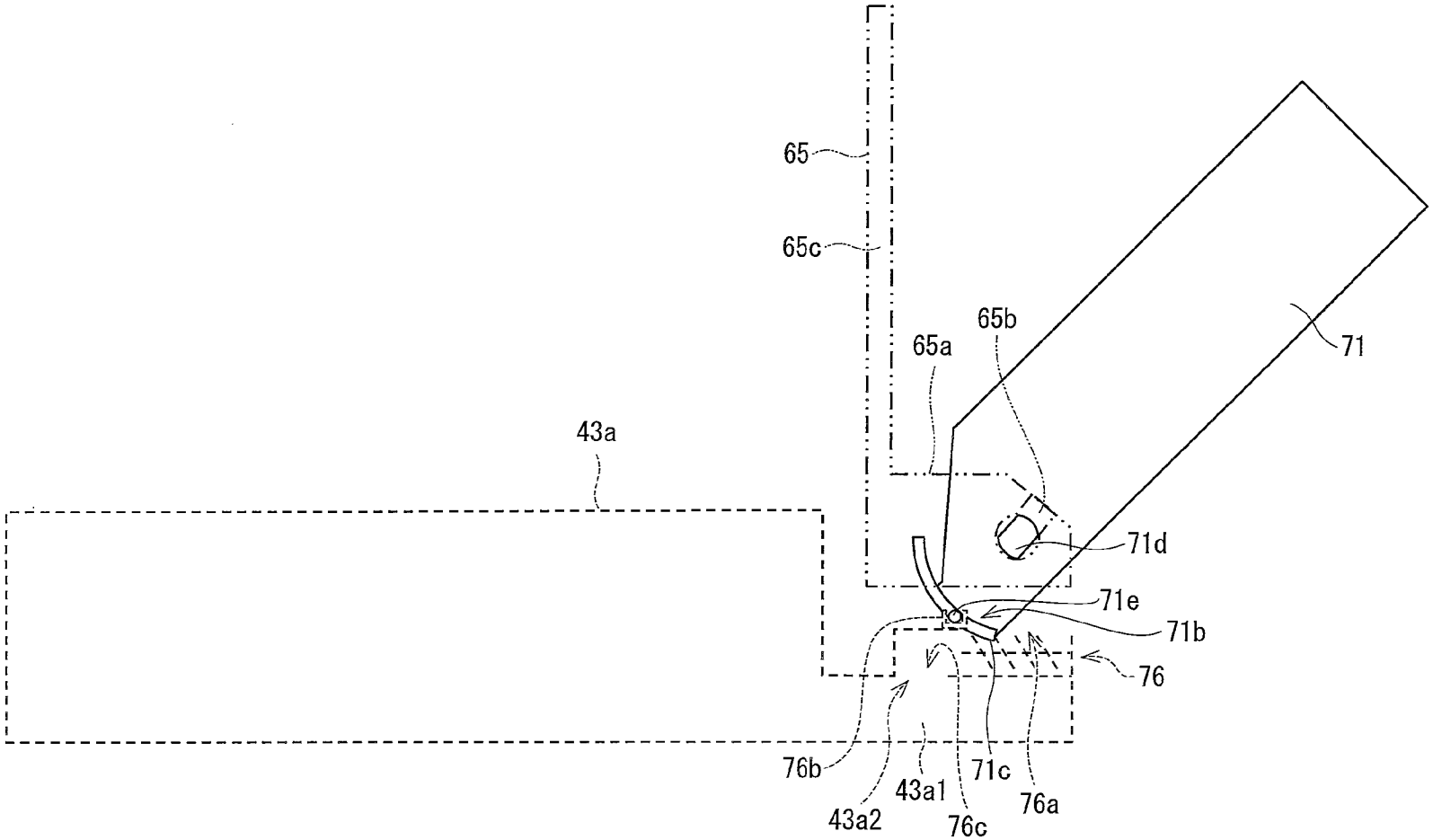
FIG. 9 is an explanatory view illustrating a state where a fitting protrusion is inserted into a fitting recess of the cartridge attachment section by moving the toner cartridge illustrated in FIG. 5 obliquely downward from above.
Figure 10:
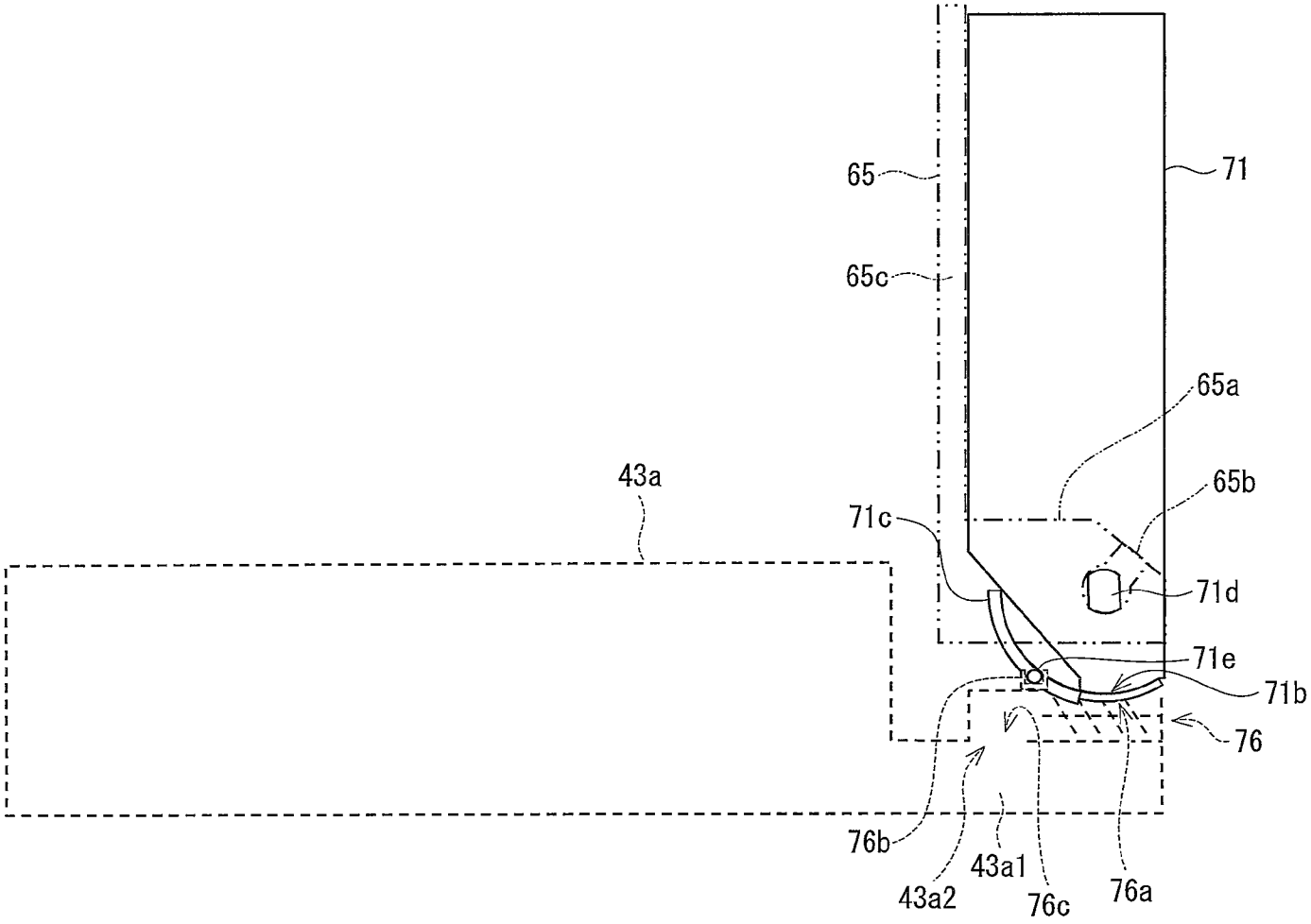
FIG. 10 is an explanatory view illustrating a state where the toner cartridge illustrated in FIG. 5 has been attached to the cartridge attachment section.

FIG. 9 is an explanatory view illustrating a state where the fitting protrusion 71*d* of the toner cartridge 71 is inserted into the fitting recess 65*b* of the cartridge attachment section 65 by moving the toner cartridge 71 obliquely downward from above. FIG. 10 is an explanatory view illustrating a state where the toner cartridge 71 has been attached to the cartridge attachment section 65.

As illustrated in FIG. 10, the intermediary toner-receiving member 76 has a toner-capturing opening 76*a*. The toner-capturing opening 76*a* is positioned to face the toner supply opening 71*b* of the toner cartridge 71 while the toner cartridge 71 is attached to the cartridge attachment section 65.

As illustrated in FIG. 9, the shutter 71*c* of the toner cartridge 71 has an engaging protrusion 71*e*, and the intermediary toner-receiving member 76 has an engaging receiving section 76*b* which engages with the engaging protrusion 71*e*.

The engaging protrusion 71*e* engages with the engaging receiving section 76*b* in a state where the fitting protrusion 71*d* of the toner cartridge 71 is inserted into the fitting recess 65*b* of the cartridge attachment section 65 by moving the toner cartridge 71 obliquely downward from above.

In this state, as illustrated in FIG. 10, when the toner cartridge 71 is rotated so as to contact the cartridge facing section 65*c* of the cartridge attachment section 65, the shutter 71*c* is opened, so that the toner supply opening 71*b* is opened. Consequently, the toner in the toner cartridge 71 is supplied to the developing device 43*a* via the toner supply opening 71*b*, the toner-capturing opening 76*a* of the intermediary toner-receiving member 76, an inside of the intermediary toner-receiving member 76, a toner supply opening 76*c* of the intermediary toner-receiving member 76, and a toner-capturing opening 43*a*2 of the toner-capturing section 43*a*1.

(Waste Toner Container)

The waste toner container 69 is shaped in a thin rectangular box, and is easily detachable from the image forming apparatus main body 2. The waste toner container 69 contains waste toners and paper powder each collected by the cleaning devices of the unit assembly 11.

(Unit Assembly)

Figure 11:
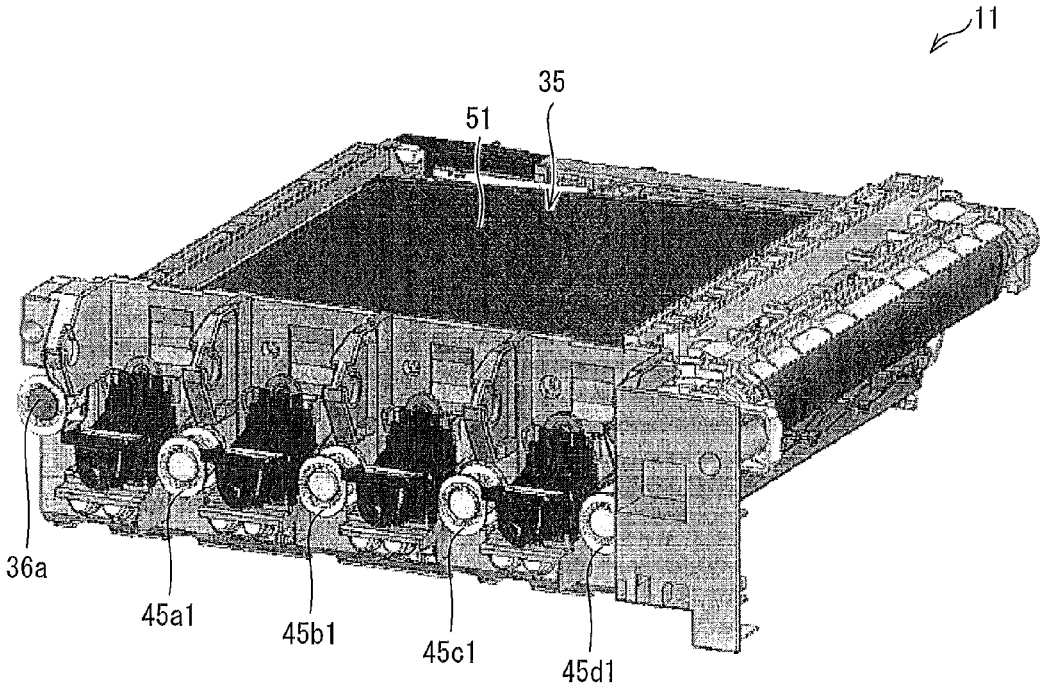
FIG. 11 is a perspective view illustrating the unit assembly illustrated in FIG. 3.
Figure 12:
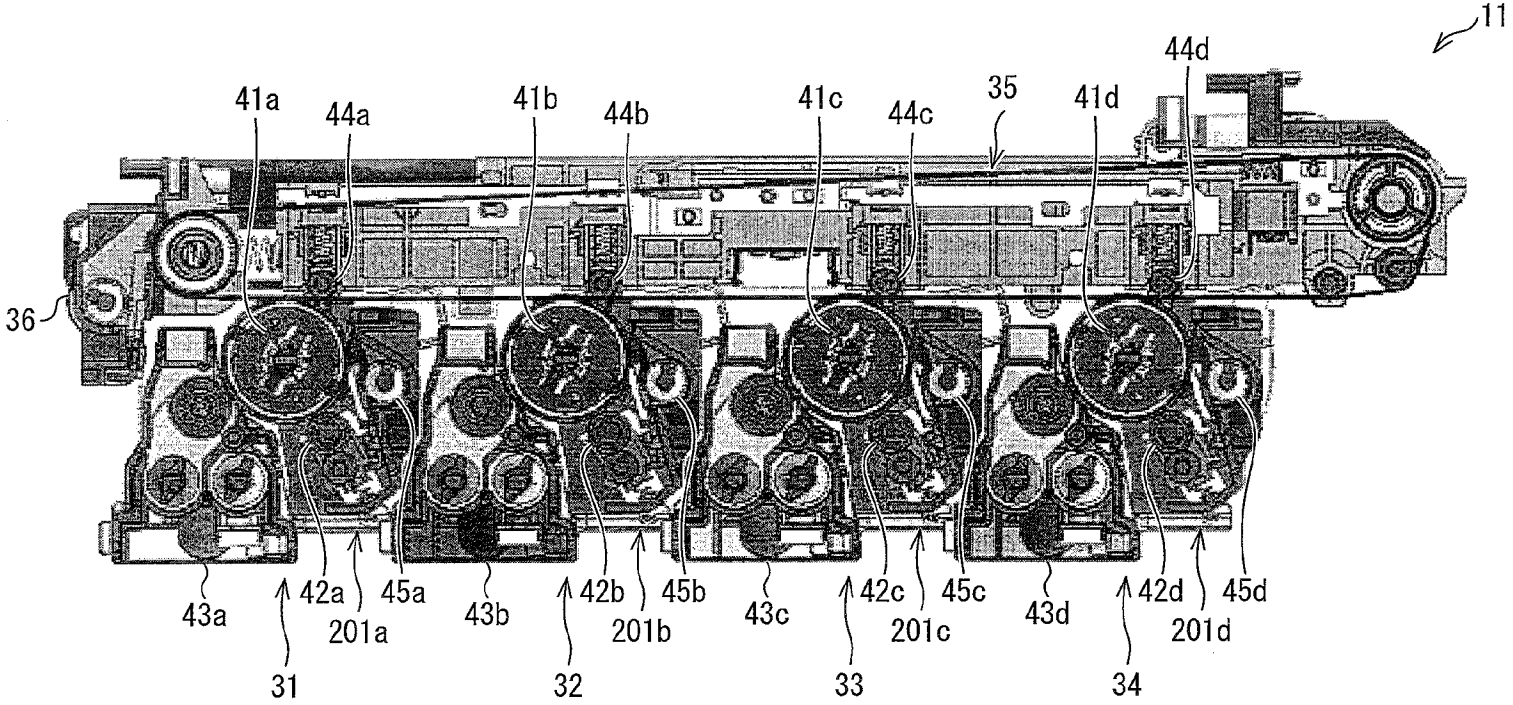
FIG. 12 is a longitudinal cross sectional view of the unit assembly illustrated in FIG. 11.

In the present embodiment, the unit assembly 11 has a configuration as illustrated in each of FIGS. 11 and 12. FIG. 11 is a perspective view illustrating the unit assembly 11, and FIG. 12 is a longitudinal cross sectional view of the unit assembly 11 illustrated in FIG. 11.

As illustrated in FIG. 11, in the unit assembly 11, (i) a waste toner carry pipe 36*a* connected with the transfer belt cleaning device 36 and (ii) waste toner carry pipes 45*a*1 through 45*d*1 connected with the photoreceptor cleaning devices 45*a* through 45*d*, respectively, protrude toward the right surface side of the image forming apparatus main body 2. The waste toner carry pipes 36*a* and 45*a*1 through 45*d* are connected with the waste toner container 69 which is attached to the image forming apparatus main body 2.

As illustrated in FIG. 12, the unit assembly 11 includes the first through fourth image forming sections 31 through 34, the intermediate transfer belt unit 35, and the transfer belt cleaning device 36.

The first image forming section 31 includes the developing device 43*a* and a first process unit 201*a*. The second image forming section 32 includes the developing device 43*b* and a second process unit 201*b*. The third image forming section 33 includes the developing device 43*c* and a third process unit 201*c*. The fourth image forming section 34 includes the developing device 43*d* and a fourth process unit 201*d*.

The first process unit 201*a* through the fourth process unit 201*d* each include at least a photoreceptor drum. In the present embodiment, the first process unit 201*a* includes the photoreceptor drum 41*a*, the charger 42*a*, the intermediate transfer roller 44*a*, and the photoreceptor cleaning device 45*a*. The second process unit 201*b* includes the photoreceptor drum 41*b*, the charger 42*b*, the intermediate transfer roller 44*b*, and the photoreceptor cleaning device 45*b*. The third process unit 201*c* includes the photoreceptor drum 41*c*, the charger 42*c*, the intermediate transfer roller 44*c*, and the photoreceptor cleaning device 45*c*. The fourth process unit 201*d* includes the photoreceptor drum 41*d*, the charger 42*d*, the intermediate transfer roller 44*d*, and the photoreceptor cleaning device 45*d*.

The unit assembly 11 is replaced with new one after, for example, a predetermined number of sheets of paper have been printed. In this case, the unit assembly 11 can be drawn out from and inserted into the right surface side of the image forming apparatus main body 2 (front side of paper in FIG. 1).

The unit assembly 11 may be a unit assembly of one of embodiments (1) through (4) below.

(1) A unit assembly obtained by integrally connecting (i) an image forming unit obtained by connecting a plurality of process units (image forming units) each including at least a photoreceptor drum and (ii) an intermediate transfer unit (e.g. intermediate transfer belt unit 35)

In this case, the image forming unit which constitutes the unit assembly 11 together with the intermediate transfer unit is not limited to one which uses two-color toners, and may be one which uses three or four color toners.

(2) A unit assembly including an intermediate transfer unit and a process unit

This one includes an image forming unit obtained by connecting, for example, an intermediate transfer unit and a process unit which uses at least two colors. In this case, the image forming unit is not limited to one which uses two toners, and may be one which uses three or four toners.

(3) A unit assembly including an intermediate transfer unit, a process unit, and a developing unit This one includes, for example, an intermediate transfer unit, a process unit which uses at least two toners, and a developing unit (developing device). In this case, a pair of the developing unit and the process unit is not limited to one which uses two toners, and may be one which uses three or four toners.

(4) A unit assembly including an intermediate transfer unit, a process unit, a developing unit, and an exposure unit This one includes, for example, an intermediate transfer unit, a process unit which uses at least two toners, a developing unit, and an exposure unit (e.g. laser optical system unit 12). In this case, a combination of the developing unit, the process unit, and the image exposure unit is not limited to one which uses two toners, and may be one which uses three or four toners.

(First Example of Side Surface Opening/Closing Door)

As illustrated in FIG. 13, the housing of the image forming apparatus main body 2 has a side surface opening/closing door 101 at the right surface of the image forming apparatus main body 2. FIG. 13 is an explanatory view illustrating how the side surface opening/closing door 101 is opened or closed. The side surface opening/closing door 101 openably covers a region where the toner cartridges 71 through 74 and the waste toner container 69 are provided. The side surface opening/closing door 101 has a handle 101*a*, and can be opened or closed in upward and downward directions around a center of a rotation support axis 102 at a lower end portion of the side surface opening/closing door 101.

In the present embodiment, the side surface opening/closing door 101 can be opened from a closing position 101*a*0 to a first opening position (small opening position) 101*a*1 or a second opening position (large opening position) 101*a*2. When the side surface opening/closing door 101 is at the first opening position 101*a*1, the toner cartridges 71 through 74 can be replaced. When the side surface opening/closing door 101 is at the second opening position 101*a*2, the waste toner container 69 and the unit assembly 11 can be replaced. An opening angle (first opening angle) of the first opening position 101*a*1 with respect to the closing position 101*a*0 is, for example, 30° through 45°, and an opening angle (second opening angle) of the second opening position 101*a*2 with respect to the closing position 101*a*0 is, for example, 90° through 110°.

(Second Example of Side Surface Opening/Closing Door)

The image forming apparatus 1 may include a side surface opening/closing door 131 illustrated in each of (a) of FIG. 14 and (b) of FIG. 14, instead of the side surface opening/closing door 101 illustrated in FIG. 13. (a) of FIG. 14 is an explanatory view illustrating another example of the side surface opening/closing door 101 illustrated in FIG. 13. (b) of FIG. 14 is an explanatory view illustrating a state where a door upper part 132 of the side surface opening/closing door 131 illustrated in (a) of FIG. 14 is opened.

As illustrated in (a) of FIG. 14, the side surface opening/closing door 131 has the door upper part 132 and a door lower part 133. The door upper part 132 and the door lower part 133 are connected with each other via an opening/closing aiding member (connecting member) 134 and a hinge (connecting member) 135. The door upper part 132 is provided with a handle 131*a*. The opening/closing aiding member 134 may be made of, for example, an elastic rubber such as NBR (nitrile butadiene rubber) or a PET (polyethylene terephthalate) film whose thickness is approximately 0.3 mm.

Specifically, as illustrated in (b) of FIG. 14, the door upper part 132 and the door lower part 133 are connected with each other via the opening/closing aiding member 134 on an internal surface side of the image forming apparatus main body 2, and the door upper part 132 and the door lower part 133 are connected with each other via the hinge 135 on an external surface side of the image forming apparatus main body 2. The opening/closing aiding member 134 is fixed to the door upper part 132 and the door lower part 133 via screws 135. In a case where the opening/closing aiding member 134 is made of a PET film, a long hole 134*a* may be formed in a portion of the opening/closing aiding member 134 which portion is fixed to the door upper part 132 or the door lower part 133. This is intended for, while the door upper part 132 is opened, allowing movement of the opening/closing aiding member 134 with respect to the screw 135 and consequently realizing smooth opening of the door upper part 132.

In the configuration of the image forming apparatus 1 including the side surface opening/closing door 131, only the door upper part 132 is opened (small opening position) in a case the toner cartridges 71 through 74 are replaced, whereas both the door upper part 132 and the door lower part 133 are opened (large opening position) in a case where the waste toner container 69 and the unit assembly 11 are replaced. In these cases, the door upper part 132 and the door lower part 133 are each opened at an opening angle of 90° through 110° as in the case of opening the side surface opening/closing door 101 to the second opening position 101*a*2.

The toner cartridges 71 through 74 may be replaced while the door upper part 132 is opened at an opening angle of, for example, 60° through 70°. In this case, the opening angle of the door upper part 132 can be adjusted by adjusting a length of the long hole 134*a* of the opening/closing aiding member 134.

With the configuration of the image forming apparatus 1 including the side surface opening/closing door 131 as above, it is possible to downsize an area where the side surface opening/closing door 131 rotates when the side surface opening/closing door 131 (door upper part 132) is opened so that the toner cartridges 71 through 74 are attached/detached to/from the image forming apparatus 1. This allows a further reduction in working space on a side of the image forming apparatus 1 which space is required in attaching/detaching the toner cartridges 71 through 74.

(Third Example of Side Surface Opening/Closing Door)

As illustrated in FIGS. 15 through 18, the side surface opening/closing door 101 may be arranged to be openable at three stages of angles; first through third opening angles. For this purpose, the image forming apparatus main body 2 includes an opening angle adjusting mechanism section 151 for opening the side surface opening/closing door 101 at three stages of angles, i.e., from a closing position 101*b*0 to a first opening position (small opening position) 101*b*1, a second opening position (medium opening position) 101*b*2, and a third opening position (large opening position) 101*b*3.

FIG. 15 is an explanatory view illustrating a state of the opening angle adjusting mechanism section 151 in a case where the side surface opening/closing door 101 is at the closing position 101*b*0. FIG. 16 is an explanatory view illustrating a state of the opening angle adjusting mechanism section 151 in a case where the side surface opening/closing door 101 is at the first opening position 101*b*1. FIG. 17 is an explanatory view illustrating a state of the opening angle adjusting mechanism section 151 in a case where the side surface opening/closing door 101 is at the second opening position 101*b*2. FIG. 18 is an explanatory view illustrating a state of the opening angle adjusting mechanism section 151 in a case where the side surface opening/closing door 101 is at the third opening position 101*b*3.

As illustrated in FIG. 15, the opening angle adjusting mechanism section 151 includes an opening angle adjusting member 152 having an elongated plate shape. The opening angle adjusting member 152 is made of, for example, PET (polyethylene terephthalate), ABS (acrylonitrile butadiene styrene), or a metal such as iron and SUS. In the image forming apparatus main body 2, the opening angle adjusting mechanism section 151 is provided in forward and backward directions of the image forming apparatus main body 2, and an end part of the opening angle adjusting mechanism section 151 which end part is closer to the back side of the image forming apparatus main body 2 is rotatably connected with a side surface of the side surface opening/closing door 101 via an axis member 153.

The opening angle adjusting member 152 has a guiding hole 152*a* extending in right and left directions of the image forming apparatus main body 2. A guiding pin 154 fixed to the image forming apparatus main body 2 is inserted into the guiding hole 152*a*. A lower side of a circumference of the guiding hole 152*a* in the opening angle adjusting member 152 forms a straight line. On the other hand, an upper side of the circumference of the guiding hole 152*a* forms a first guiding part 152*a*1, a first locking part 152*a*2, a second guiding part 152*a*3, and a second locking part 152*a*4 in this order from a right end part (end part closer to the side surface opening/closing door 101) of the guiding hole 152*a* toward a left end part of the guiding hole 152*a*. The left end part (end part) of the guiding hole 152*a* which end part is positioned to the left of the second locking part 152*a*4 serves as a third locking part 152*a*5.

The first guiding part 152*a*1 and the second guiding part 152*a*3 are inclined obliquely upward and then get horizontal. The first locking part 152*a*2 and the second locking part 152*a*4 extend downward from respective end parts of the first guiding part 152*a*1 and the second guiding part 152*a*3. The guiding pin 154 engages with the first locking part 152*a*2, the second locking part 152*a*4, and the second guiding section 152*a*3. This prevents movement of the opening angle adjusting member 152 toward the right surface side of the image forming apparatus main body 2 due to opening of the side surface opening/closing door 101.

In the above configuration, the toner cartridges 71 through 74 are replaced with respective new ones when the toner cartridges 71 through 74 get empty, the waste toner container 69 is replaced with new one when the waste toner container 69 is fully filled with a collected waste toner, and the unit assembly 11 is replaced with new one when, for example, the number of printed sheets of paper reaches a predetermined number. These replacements are made in accordance with, for example, display on the operation panel 21.

Replacement cycles for the toner cartridges 71 through 74, the waste toner container 69, and the unit assembly 11, respectively, are as below.

Toner cartridges 71 through 74: approximately every 4,000 printed sheets of paper Waste toner container 69: approximately every 10,000 printed sheets of paper Unit assembly 11: approximately every 60,000 printed sheets of paper (Replacement of Toner Cartridge)

In order to replace the toner cartridges 71 through 74, a worker extends his/her hand to the right surface of the image forming apparatus 1 and pulls the handle 101*a* of the side surface opening/closing door 101, so that the side surface opening/closing door 101 is opened to the first opening position 101*al*.

Next, while the side surface opening/closing door 101 is opened to the first opening position 101*a*1, the worker replaces, with his/her right hand, one of the toner cartridges 71 through 74 which one is to be replaced.

For example, in order to replace the toner cartridge 71, the worker rotates the toner cartridge 71 in a rightward direction (clockwise) around the fitting protrusion 71*d* (see FIG. 9) from a position where the toner cartridge 71 is attached to the cartridge attachment section 65 (state in which the attachment has been completed) (see FIG. 10).

Next, the worker moves the toner cartridge 71 obliquely upward while the toner cartridge 71 is at the angle illustrated in FIG. 9. Thus, the fitting protrusion 71*d* of the toner cartridge 71 is drawn out from the fitting recess 65*b* of the cartridge attachment section 65. In this case, the shutter 71*c* is closed, so that the toner supply opening 71*b* is blocked.

On the other hand, in a case where the worker attaches a new toner cartridge 71, the worker is only required to carry out an operation reverse to the above operation, so that the toner cartridge 71 is attached as illustrated in FIG. 10.

(Replacement of Waste Toner Container)

In order to replace the waste toner container 69, the worker opens the side surface opening/closing door 101 to the second opening position 101*a*2. Next, the worker pulls, with his/her right hand, the waste toner container 69 to a left surface side of the image forming apparatus main body 2 and replaces the waste toner container 69 with new one.

(Replacement of Unit Assembly)

In order to replace the unit assembly 11 with new one, the worker opens the side surface opening/closing door 101 to the second opening position 101*a*2 as in the case of the replacement of the waste toner container 69.

Next, the worker removes, from the image forming apparatus main body 2, the toner cartridges 71 through 74, the cartridge attachment sections 65 through 68, the waste toner container 69, etc., each of which is provided to a right of the unit assembly 11, and then draws out the unit assembly 11 from the image forming apparatus main body 2 and replaces it with new one.

In this working operation, in a case where a working space can be provided on the right surface side of the image forming apparatus main body 2, the worker may carry out the working operation on the right surface side of the image forming apparatus main body 2. Alternatively, the worker may carry out the working operation after horizontally rotating the image forming apparatus main body 2 by 90° so that the right surface side of the image forming apparatus main body 2 is positioned on a front surface side thereof.

(Working Frequency and Workability for Each Working Operation)

FIG. 19 is an explanatory view illustrating a relation among each target to be replaced or supplied, a working position of a worker with respect to the image forming apparatus 1, an opening degree of the side surface opening/closing door, and difficulty in the working operation in cases where the image forming apparatus 1 includes the side surface opening/closing door 101 of the first example and where the image forming apparatus 1 includes the side surface opening/closing door 131 of the second example. FIG. 20 is an explanatory view illustrating a relation among each target to be replaced or supplied, a working position of a worker with respect to the image forming apparatus 1, an opening degree of the side surface opening/closing door, and difficulty in the working operation in a case where the image forming apparatus 1 includes the side surface opening/closing door 101 of the third example.

The terms "front surface position" and "front surface side position" differ in that the "front surface position" indicates a case where a worker can carry out a working operation on the front surface of the image forming apparatus 1 while positioned in front of the image forming apparatus 1, and the "front surface side position" indicates a case where a worker carries out a working operation on the side surface of the image forming apparatus 1 while positioned in front of the image forming apparatus 1.

In FIGS. 19 and 20, targets to be replaced or supplied are listed from above to below in the order of working frequency (frequency in supply or replacement). It should be noted that targets being substantially equal in working frequency may be listed so as to be vertically adjacent to each other depending on a state of use of the image forming apparatus 1.

As illustrated in FIGS. 19 and 20, in a case of using the image forming apparatus 1, working frequency in "supply of paper" is relatively high. A worker at the front surface position of the image forming apparatus 1 can carry out this working operation by drawing out the paper feeding cassette 13 forward in order to supply paper and then pushing back the paper feeding cassette 13. Accordingly, the difficulty in the working operation of "supply of paper" is low.

Working frequency in "collection of printed paper" is relatively high, and is substantially equal to or a little above or below the working frequency in "supply of paper", depending on a state of use of the image forming apparatus 1. In this working operation, the worker at the front surface position of the image forming apparatus 1 can collect printed paper outputted from the back surface side of the image forming apparatus 1 onto the paper output tray 16. Accordingly, the difficulty in the working operation of "collection of printed paper" is low.

The toner cartridges 71 through 74 are replaced with approximately moderate working frequency of the targets listed in FIGS. 19 and 20. In this working operation, the worker at the front surface side position of the image forming apparatus 1 can replace any of the toner cartridges 71 through 74 with new one by extending his/her hand to the right surface side of the image forming apparatus 1 and opening the side surface opening/closing door 101 or the side surface opening/closing door 131.

In this working operation, in the case of the side surface opening/closing door 101 (first example, third example), the side surface opening/closing door 101 is opened to the first opening position 101*a*1 or 101*b*1 (small opening position), and in the case of the side surface opening/closing door 131 (second example), only the door upper part 132 is opened. That is, the opening degree of each of the side surface opening/closing doors of the first through third examples is low. Therefore, by securing a relatively small space which allows the side surface opening/closing door 101 or the side surface opening/closing door 131 to be opened with a low opening degree on a side of the image forming apparatus 1, it is possible to replace any of the toner cartridges 71 through 74 with new one without movement of the worker to the right surface side of the image forming apparatus 1.

The side surface opening/closing door 101 or 131 may be provided on a left surface of the image forming apparatus 1. However, since the side surface opening/closing door 101 or 131 is provided on the right surface side of the image forming apparatus 1, right-handed persons who are considered to account for approximately 70% of the population can easily carry out the operation of replacing the toner cartridges 71 through 74 with his/her dominant hand. In view of the above, difficulty in replacement of the toner cartridges 71 through 74 is approximately moderate.

The waste toner container 69, which is replaced with lower working frequency than the toner cartridges 71 through 74, is replaced with approximately moderate working frequency in the targets listed in FIGS. 19 and 20. In this working operation, the worker at the front surface side position of the image forming apparatus 1 can replace the waste toner container 69 with new one by extending his/her hand to the right surface side of the image forming apparatus 1 and opening the side surface opening/closing door 101 or the side surface opening/closing door 131.

In this working operation, the side surface opening/closing door 101 of the first example is opened to the second opening position 101*a*2 (large opening position), the side surface opening/closing door 131 of the second example is opened in such a manner that both the door upper part 132 and the door lower part 133 are opened (corresponding to the large opening position), and the side surface opening/closing door 101 of the third example is opened to the second opening position 101*b*2 (medium opening position). That is, the side surface opening/closing doors of the first and second examples are opened with a high opening degree, and the side surface opening/closing door of the third example is opened with a medium opening degree. Therefore, by securing, on a side of the image forming apparatus 1, a space which allows the side surface opening/closing door 101 or the side surface opening/closing door 131 to be opened at the medium opening position or at the large opening position, it is possible to replace the waste toner container 69 with new one without movement of the worker to the right surface side of the image forming apparatus 1.

Since the side surface opening/closing door 101 or 131 is provided on the right surface side of the image forming apparatus 1, right-handed persons who are considered to account for approximately 70% of the population can easily carry out the operation of replacing the waste toner container 69 with his/her dominant hand. In view of the above, difficulty in replacement of the waste toner container 69 is approximately moderate.

Working frequency in the replacement of the unit assembly 11 is relatively high. In this working operation, while going to a position on the right surface side of the image forming apparatus 1 or rotating the image forming apparatus 1 by 90° so that the right surface of the image forming apparatus 1 comes to be positioned on a front surface side of the image forming apparatus 1, the worker can replace the unit assembly 11 by opening the side surface opening/closing door 101 or 131.

In this working operation, the side surface opening/closing door 101 of the first example is opened to the second opening position 101*a*2 (large opening position), the side surface opening/closing door 131 of the second example is opened in such a manner that both the door upper part 132 and the door lower part 133 are opened (corresponding to the large opening position), and the side surface opening/closing door 101 of the third example is opened to the third opening position 101*b*3 (large opening position). That is, the side surface opening/closing doors of the first, second, and third examples are opened with a high opening degree. In view of the above, difficulty in the replacement of the unit assembly 11 is great.

As described above, in the image forming apparatus 1, a position where a target to be replaced or supplied is provided is determined in accordance with working frequency in replacement or supply of the target. Specifically, the target to be replaced or supplied is positioned in such a manner that the working operation is carried out with respect to the target with lower difficulty as the target is subject to the working operation with higher frequency. This allows the image forming apparatus to have excellent workability in terms of working operations including supply of supplies, replacement of consumable articles, and replacement of the unit assembly.

(Other Advantages of Image Forming Apparatus)

In the image forming apparatus 1, since the toner cartridges 71 through 74, the waste toner container 69, and the unit assembly 11 can be replaced with new ones while the side surface opening/closing door 101 which is shared by them is opened, such an operation can be easily carried out. Furthermore, since the image forming apparatus 1 requires a smaller number of the opening/closing door, it is possible to simplify the structure of the image forming apparatus 1.

The toner cartridges 71 through 74 are attached to the image forming apparatus 1 by, while opening the side surface opening/closing door 101 to the first opening position 101*a*1 or 101*b*1 or obliquely opening the door upper part 132 of the side surface opening/closing door 131, inserting the toner cartridges 71 through 74 into the image forming apparatus 1 obliquely downward from above and then rotating the toner cartridges 71 through 74 in a direction in which the image forming apparatus 1 extends (counterclockwise). That is, the toner cartridges 71 through 74 are not attached to the image forming apparatus 1 by attaching the toner cartridges 71 through 74 to the side surface opening/closing door 101 and then closing the side surface opening/closing door 101 so that the toner cartridges 71 through 74 are attached to predetermined attachment positions. This causes no inconvenience such that the toner cartridges 71 through 74 are less likely to be attached to predetermined attachment positions in a case where the side surface opening/closing door 101 which has been deformed as a result of long-year use is closed.

Furthermore, in the case of attaching the toner cartridges 71 through 74 to the image forming apparatus 1, while the side surface opening/closing door 101 or 131 is being opened, the cartridge attachment sections 65 through 68 are not rotated to positions for receiving insertion of the toner cartridges 71 through 74, and accordingly the side surface opening/closing door 101 or 131 may be opened only with a small opening angle. This also makes it possible to carry out a working operation in a small working space.

Therefore, the image forming apparatus 1 in accordance with the present embodiment allows easy replacement of the toner cartridges 71 through 74, the waste toner container 69, and the unit assembly 11 and allows a structure thereof to be simpler by reducing the number of necessary opening/closing doors.

[Second Embodiment]

The following description will discuss another embodiment of the present invention with reference to FIGS. 1 through 4, 11 through 13, and 21.

An image forming apparatus 5 in accordance with another embodiment of the present invention is different from the image forming apparatus 1 on the points mentioned below. Except for the points mentioned below, the image forming apparatus 5 is the same as the image forming apparatus 1 in accordance with First Embodiment.

(Paper Feeding Cassette)

FIG. 2 is a perspective view of the image forming apparatus 5 in accordance with the embodiment of the present invention, which includes an automatic document feeder 3 and from which a housing has been removed.

As illustrated in FIG. 2, a paper feeding cassette 13 is provided in a lower part of the image forming apparatus 5, and can be drawn out toward a front surface side of the image forming apparatus 5 (image forming apparatus main body 2) by pulling a handle 13*a*. The image forming apparatus 5 has an operation panel 21 in an upper part on the front surface side thereof.

(Overview of Components to be Attached to Image Forming Apparatus)

As illustrated in FIGS. 3 and 4, toner cartridges 71 through 74 each have a longitudinal shape in upward and downward directions, and contain a yellow toner, a magenta toner, a cyan toner, and a black toner, respectively. The toner cartridges 71 through 74 can supply the respective toners to the corresponding developing devices 43*a* through 43*d* while being attached to the cartridge attachment sections 65 through 68, respectively.

The toner cartridges 71 through 74 and the waste toner container 69 can be replaced with new ones by opening a side surface opening/closing door 101. As illustrated in FIG. 4, the side surface opening/closing door 101 is provided on a right surface of a housing of the image forming apparatus main body 2.

As illustrated in FIG. 13, the side surface opening/closing door 101 is openable at two stages of angles. FIG. 13 is an explanatory view illustrating how the side surface opening/closing door 101 is opened or closed. The side surface opening/closing door 101 has a handle 101*a*, and can be opened or closed in upward and downward directions around a center of a rotation support axis 102 at a lower end portion of the side surface opening/closing door 101.

The toner cartridges 71 through 74 are attached/detached while the side surface opening/closing door 101 is opened from a closing position 101*a*0 to a first opening position (small opening position) 101*a*1. In the attachment operation, the toner cartridges 71 through 74 are moved obliquely downward from above so as to be attached to the image forming apparatus main body 2, and then are rotated to be upright. In the detachment operation, the toner cartridges 71 through 74 are detached from the image forming apparatus main body 2 by an operation reverse to the attachment operation.

The waste toner container 69 is attached/detached while the side surface opening/closing door 101 is opened from the closing position 101*a*0 to the second opening position (large opening position) 101*a*2.

(Unit Assembly)

As illustrated in FIG. 1, the unit assembly 11 is provided on the paper feeding cassette 13 in the image forming apparatus main body 2 (image forming apparatus 5). The unit assembly 11 is attached/detached while the side surface opening/closing door 101 is opened to the second opening position 101*a*2 illustrated in FIG. 13. In this case, the toner cartridges 71 through 74, the waste toner container 69, etc. are removed before the unit assembly 11 is attached/detached. That is, the unit assembly 11 is attached to/detached from the image forming apparatus main body 2 on the right surface side of the image forming apparatus main body 2.

(Workability with Respect to Paper Feeding Cassette and Unit Assembly)

FIG. 21 is an explanatory view illustrating a relation between the paper feeding cassette 13 and the unit assembly 11.

As illustrated in FIG. 21, a working surface through which paper is supplied to the paper feeding cassette 13 is a front surface of the image forming apparatus 5 (front surface of the apparatus), and a working surface through which the unit assembly 11 is attached/detached is the right side surface of the image forming apparatus 5 (side surface of the apparatus). These two working surfaces are adjacent to each other. The working surface for the paper feeding cassette 13 (front surface of the apparatus) is a surface close to a worker positioned in front of the apparatus, and the working surface for the unit assembly 11 (side surface of the apparatus) is a surface spaced from the worker positioned in front of the apparatus.

Note that the paper feeding cassette 13 is inserted into or drawn out from the image forming apparatus 5 in a direction perpendicular to the front surface of the image forming apparatus 5. On the other hand, the unit assembly is attached to or detached from the image forming apparatus 5 in a direction perpendicular to the side surface (right side surface) of the image forming apparatus 5.

Consequently, even in a case where a toner is scattered from the unit assembly 11 during attachment/detachment of the unit assembly 11, the image forming apparatus 5 can prevent paper in the paper feeding cassette 13 from being stained by the scattered toner.

Furthermore, also in a case where an operation with respect to the paper feeding cassette 13 and attachment/detachment of the unit assembly 11 are carried out at the same time, the paper feeding cassette 13 and the unit assembly 11 do not interfere with each other, so that both of these operations can be carried out smoothly at the same time.

Furthermore, since the working surface for the paper feeding cassette 13 (front surface of the apparatus) and the working surface for the unit assembly 11 (side surface of the apparatus) are adjacent to each other, a worker who carries out both the operations is only required to move a little. This results in favorable workability.

(Other Advantages of Image Forming Apparatus)

Other advantages of the image forming apparatus have been already described in First Embodiment.

As described above, an image forming apparatus of the present invention is an image forming apparatus, comprising: a section configured to receive a supply; a component to be replaced; an image forming unit configured to form a toner image; and working sections that are the section configured to receive the supply, an attachment and detachment section configured to replace the component to be replaced, and an attachment and detachment section configured to replace the image forming unit, the working sections being distributed on a front surface and a side surface of the image forming apparatus, out of the working sections, at least one high-frequency working section and at least one low-frequency working section being provided on the front surface and the side surface, respectively, the at least one high-frequency working section being relatively high in working frequency with which a supply operation or a replacement operation is carried out, and the at least one low-frequency working section being relatively low in the working frequency.

With the arrangement, out of the sections that are the section configured to receive a supply, the attachment and detachment section configured to replace the component to be replaced, and the attachment and detachment section configured to replace the image forming unit, at least one high-frequency working section relatively high in working frequency with which a supply operation or a replacement operation is carried out is provided on the front surface of the image forming apparatus, and at least one low-frequency working section relatively low in the working frequency is provided on the side surface of the image forming apparatus.

Consequently, out of supply of supplies to the section configured to receive a supply, replacement of consumable articles, and replacement of the image forming unit, a worker easily carries out, with relatively low difficulty, an operation with relatively high working frequency on the at least one high-frequency working section provided on the front surface of the image forming apparatus. Furthermore, out of these operations, a worker can carry out, with relatively low difficulty, an operation with relatively low working frequency on the at least low-frequency working section provided on the side surface of the image forming apparatus.

This allows the image forming apparatus to have excellent workability in terms of working operations including supply of supplies, replacement of consumable articles, and replacement of the unit assembly.

The image forming apparatus of the present invention may be arranged such that the at least one low-frequency working section provided on the side surface of the image forming apparatus includes (i) a first low-frequency working section which is subjected to an operation carried out by a worker who is positioned in front of the image forming apparatus, and (ii) a second low-frequency working section which is lower in the working frequency than the first low-frequency working section and which is subjected to an operation carried out by the worker who is positioned on a side of the image forming apparatus.

With the arrangement, out of a plurality of working sections provided on the side surface of the image forming apparatus, a worker can carry out an operation, from a position in front of the image forming apparatus, on the first low-frequency working section such as a section configured to replace a toner cartridge or a section configured to replace a waste toner container.

On the other hand, with respect to the second low-frequency working operation which is low in the working frequency than the first low-frequency working section, such as the working section configured to replace the image forming unit (unit assembly), a worker goes to a position at a side of the image forming apparatus and carries out an operation at the position. Alternatively, a worker carries out an operation after rotating the image forming apparatus by 90° so that the worker in front of the image forming apparatus faces the side surface of the image forming apparatus.

Consequently, even in a case of the low-frequency working operation provided at the side surface of the image forming apparatus, a worker can easily carry out an operation on the first low-frequency working operation with relatively high working frequency.

The image forming apparatus of the present invention may be arranged such that the image forming apparatus has a housing whose side surface is provided with a side surface opening/closing door, the side surface opening/closing door being openable (i) at a small opening position at which the side surface opening/closing door is opened at a relatively small opening angle and (ii) at a large opening position at which the side surface opening/closing door is opened at a relatively large opening angle, and the operation with respect to the first low-frequency working section is carried out while the side surface opening/closing door is opened at the small opening position, and the operation with respect to the second low-frequency working section is carried out while the side surface opening/closing door is opened at the large opening position.

With the arrangement, the operation on the first low-frequency working section is carried out by a worker in front of the image forming apparatus while the side surface opening door is opened at the small opening position. The operation on the second low-frequency working section is carried out by a worker on a side of the image forming apparatus, i.e. a worker who faces the side surface of the image forming apparatus, while the side surface opening/closing door is opened at the large opening position. In contrast, an operation on the high-frequency working section positioned in front of the image forming apparatus is carried out while the side opening door is not opened.

Accordingly, the operations on the section configured to receive a supply, the attachment and detachment section configured to replace a component to be replaced, and the attachment and detachment section configured to replace the image forming unit can be carried out efficiently with lower difficulty as working frequency is higher.

The image forming apparatus of the present invention may be arranged such that the at least one high-frequency working section includes a paper output section to which printed paper is output and a paper feeding section at which paper for printing is provided, the first low-frequency working section is a section to which a toner cartridge is attached, and the second low-frequency working section is a section to which the image forming unit is attached.

With the arrangement, the operation on the high-frequency working section including the paper output section to which printed paper is output and the paper feeding section at which paper for printing is provided, i.e., the operation of collecting printed paper from the paper output section and the operation of supplying paper for printing to the paper feeding section are carried out on the front surface of the image forming apparatus by a worker in front of the image forming apparatus.

The operation on the first low-frequency working section which is the section to which a toner cartridge is attached, i.e., the operation of replacing a toner cartridge is carried out by a worker while the side surface opening/closing door is opened at the small opening position.

The operation on the second low-frequency working section which is the section to which an image forming unit is attached, i.e., the operation of replacing an image forming unit is carried out by a worker who faces the side surface of the image forming apparatus while the side surface opening/closing door is opened at the large opening position.

Consequently, the operation of collecting printed paper from the paper output section, the operation of supplying paper for printing to the paper feeding section, the operation of replacing a toner cartridge, and the operation of replacing an image forming unit can be carried out efficiently with lower difficulty as working frequency is higher.

The image forming apparatus of the present invention may be arranged such that the a least one low-frequency working section provided on the side surface of the image forming apparatus includes (i) a first low-frequency working section which is subjected to an operation carried out by a worker who is positioned in front of the image forming apparatus, (ii) a second low-frequency working section which is lower in the working frequency than the first low-frequency working section and which is subjected to an operation carried out by the worker who is positioned on a side of the image forming apparatus, and (iii) a third low-frequency working section which is lower in the working frequency than the first low-frequency working section and higher in the working frequency than the second low-frequency working section and which is subjected to an operation carried out by the worker who is positioned on the side of the image forming apparatus, the image forming apparatus has a housing whose side surface is provided with a side surface opening/closing door, the side surface opening/closing door being openable (i) at a small opening position at which the side surface opening/closing door is opened at a relatively small opening angle, (ii) at a large opening position at which the side surface opening/closing door is opened at a relatively large opening angle, and (iii) at a medium opening position at which the side surface opening/closing door is opened at an opening angle larger than the small opening angle and smaller than the large opening angle, and the operation with respect to the first low-frequency working section is carried out while the side surface opening/closing door is opened at the small opening position, the operation with respect to the second low-frequency working section is carried out while the side surface opening/closing door is opened at the large opening position, and the operation with respect to the third low-frequency working section is carried out while the side surface opening/closing door is opened at the medium opening position.

With the arrangement, the operation on the first low-frequency working section is carried out by a worker in front of the image forming apparatus while the side surface opening/closing door is opened at the small opening position.

The operation on the second low-frequency working section is carried out by a worker on a side of the image forming apparatus, i.e. a worker who faces the side surface of the image forming apparatus, while the side surface opening/closing door is opened at the large opening position.

The operation on the third low-frequency working section is carried out by a worker in front of the image forming apparatus while the side surface opening/closing door is opened at the medium opening position. In contrast, an operation on the high-frequency working section provided on the front surface of the image forming apparatus is carried out without opening the side surface opening/closing door.

Accordingly, the operations on the section configured to receive a supply, the attachment and detachment section configured to replace a component to be replaced, and the attachment and detachment section configured to replace the image forming unit can be carried out efficiently with lower difficulty as working frequency is higher.

The image forming apparatus of the present invention may be arranged such that the at least one high-frequency working section includes a paper output section to which printed paper is output and a paper feeding section at which paper for printing is provided, the first low-frequency working section is a section to which a toner cartridge is attached, the second low-frequency working section is a section to which the image forming unit is attached, and the third low-frequency working section is a section to which a waste toner container is attached.

With the arrangement, the operation on the at least one high-frequency working section including the paper output section to which printed paper is output and the paper feeding section at which paper for printing is provided, i.e., the operation of collecting printed paper from the paper output section and the operation of supplying paper for printing to the paper feeding section are carried out on the front surface of the image forming apparatus by a worker in front of the image forming apparatus.

The operation on the first low-frequency working section which is the section to which a toner cartridge is attached, i.e., the operation of replacing a toner cartridge is carried out by a worker while the side surface opening/closing door is opened at the small opening position.

The operation on the second low-frequency working section which is the section to which an image forming unit is attached, i.e., the operation of replacing an image forming unit is carried out by a worker who faces the side surface of the image forming apparatus while the side surface opening/closing door is opened at the large opening position.

The operation on the third low-frequency working section which is the section to which a waste toner container is attached, i.e., the operation of replacing a waste toner container is carried out by a worker in front of the image forming apparatus while the side surface opening/closing door is opened at the medium opening position.

Consequently, the operation of collecting printed paper from the paper output section, the operation of supplying paper for printing to the paper feeding section, the operation of replacing a toner cartridge, the operation of replacing an image forming unit, and the operation of replacing a waste toner container can be carried out efficiently with lower difficulty as working frequency is higher.

An image forming apparatus of the present invention is an image forming apparatus, in which a plurality of process units including respective photoreceptors and corresponding to respective colors each carry out an electrophotographic process so as to form developer images on the respective photoreceptors, the developer images of the respective colors are transferred from the respective photoreceptors to an intermediate transfer member of an intermediate transfer unit while being overlapped on the intermediate transfer member so as to form a multi-color developer image, and the multi-color developer image is transferred from the intermediate transfer member onto paper, the image forming apparatus comprising a unit assembly including: an image forming unit including the plurality of process units; and the intermediate transfer unit, the image forming apparatus having a front surface and a side surface, one of which is a working surface through which the unit assembly is attached to or detached from the image forming apparatus and the other of which is a working surface through which a paper feeding tray that contains the paper and that is included in the image forming apparatus is inserted into or drawn out from the image forming apparatus, the side surface being adjacent to the front surface.

With the arrangement, one of the front surface of the image forming apparatus and the side surface of the image forming apparatus which side surface is adjacent to the front surface is a working surface through which the unit assembly is attached or detached, and the other is a working surface through which a paper feeding tray is inserted or drawn out.

Therefore, in the image forming apparatus, even when a toner is scattered from the unit assembly in attachment/detachment of the unit assembly, it is possible to prevent paper in the paper feeding tray from being stained by the scattered toner.

Furthermore, in a case where an operation on the paper feeding tray and attachment/detachment of the unit assembly are carried out at the same time, the paper feeding tray and the unit assembly do not interfere with each other, so that both operations can be made smoothly at the same time.

Furthermore, since the working surface for the paper feeding tray and the working surface for the unit assembly are adjacent to each other, a worker who carries out both operations is only required to move a little, resulting in good workability.

Furthermore, although the unit assembly which includes the image forming unit including a plurality of process units and the intermediate transfer unit is larger in size than individual image forming units, the unit assembly allows easily securing a space for attaching/detaching the unit assembly since the unit assembly is attached/detached at a working surface different from the working surface for the paper feeding tray.

The image forming apparatus of the present invention may be arranged such that the front surface thereof is the working surface for the paper feeding tray, and the side surface thereof is the working surface for the unit assembly.

With the arrangement, the front surface of the image forming apparatus is the working surface for the paper feeding tray with relatively high working frequency, and the side surface of the image forming apparatus is the working surface for the unit assembly with relatively low working frequency, resulting in good workability.

The image forming apparatus of the present invention may be arranged such that the image forming apparatus has a housing whose side surface is provided with a side surface opening/closing door, a toner cartridge for supplying a toner as a developer and a waste toner container for containing a waste toner are attached to a region on an inner side of the side surface opening/closing door, and the unit assembly is attached or detached while the side surface opening/closing door is opened.

With the arrangement, a toner cartridge and a waste toner container are attached to the region on an inner side of the side surface opening/closing door, and the unit assembly is attached or detached while the side surface opening/closing door is opened. That is, since the toner cartridge, the waste toner container, and the unit assembly can be replaced with new ones while the side surface opening/closing door which is common among them is opened, these operations are easy to carry out. Furthermore, since the image forming apparatus requires smaller number of the opening/closing door, it is possible to simplify the structure of the image forming apparatus.

The present invention is not limited to the description of the embodiments above, but may be altered by a skilled person within the scope of the claims. An embodiment based on a proper combination of technical means disclosed in different embodiments is encompassed in the technical scope of the present invention.

REFERENCE SIGNS LIST

1 Image forming apparatus
2 Image forming apparatus main body
5 Image forming apparatus
11 Unit assembly (component to be replaced)
13 Paper feeding cassette (paper feeding section, section for receiving a supply)
14 Transfer section
15 Fixing section
16 Paper output tray (paper output section)
21 Operation panel
31-34 First through fourth image forming sections
35 Intermediate transfer belt unit
36 Transfer belt cleaning device
36*a* Waste toner carry pipe
41*a*-41*d* Photoreceptor drum
43*a*-43*d* Developing device
51 Intermediate transfer belt
65-68 Cartridge attachment section
69 Waste toner container (component to be replaced)
71-74 Toner cartridge (component to be replaced)
71*a* Toner storing section
71*b* Toner supply opening
71*c* Shutter
71*d* fitting protrusions
71*d*1 Curved surface
71*d*2 Straight portion
101 Side surface opening/closing door
101*a*0 Closing position
101*a*1 First opening position (small opening position)
101*a*2 Second opening position (large opening position)
101*b*0 Closing position
101*b*1 First opening position (small opening position)
101*b*2 Second opening position (medium opening position)
101*b*3 Third opening position (large opening position)
201*a* First process unit (image forming unit)
201*b* Second process unit (image forming unit)
201*c* Third process unit (image forming unit)
201*d* Fourth process unit (image forming unit)
131 Side surface opening/closing door
132 Door upper part
133 Door lower part

The invention claimed is:

1. An image forming apparatus comprising:

a section configured to receive a supply;

a component to be replaced;

an image forming unit configured to form a toner image; and working sections that are the section configured to receive the supply, an attachment and detachment section configured to replace the component to be replaced, and an attachment and detachment section configured to replace the image forming unit, the working sections being distributed on a front surface and a side surface of the image forming apparatus, wherein out of the working sections, at least one high-frequency working section and at least one low-frequency working section being provided on the front surface and the side surface, respectively, the at least one high-frequency working section being relatively high in working frequency with which a supply operation or a replacement operation is carried out, and the at least one low-frequency working section being relatively low in the working frequency, and the at least one low-frequency working section provided on the side surface of the image forming apparatus includes (i) a first low-frequency working section which is subjected to an operation carried out by a worker who is positioned in front of the image forming apparatus, and (ii) a second low-frequency working section which is lower in the working frequency than the first low-frequency working section and which is subjected to an operation carried out by the worker who is positioned on a side of the image forming apparatus.

2. The image forming apparatus as set forth in claim 1, wherein the image forming apparatus has a housing whose side surface is provided with a side surface opening/closing door, the side surface opening/closing door being openable (i) at a small opening position at which the side surface opening/closing door is opened at a relatively small opening angle and (ii) at a large opening position at which the side surface opening/closing door is opened at a relatively large opening angle, and the operation with respect to the first low-frequency working section is carried out while the side surface opening/closing door is opened at the small opening position, and the operation with respect to the second low-frequency working section is carried out while the side surface opening/closing door is opened at the large opening position.

3. The image forming apparatus as set forth in claim 2, wherein the at least one high-frequency working section includes a paper output section to which printed paper is output and a paper feeding section at which paper for printing is provided, the first low-frequency working section is a section to which a toner cartridge is attached, and the second low-frequency working section is a section to which the image forming unit is attached.

4. An image forming apparatus comprising:

a section configured to receive a supply;

a component to be replaced;

an image forming unit configured to form a toner image; and working sections that are the section configured to receive the supply, an attachment and detachment section configured to replace the component to be replaced, and an attachment and detachment section configured to replace the image forming unit, the working sections being distributed on a front surface and a side surface of the image forming apparatus, wherein out of the working sections, at least one high-frequency working section and at least one low-frequency working section being provided on the front surface and the side surface, respectively, the at least one hiqh-frequency working section being relatively high in working frequency with which a supply operation or a replacement operation is carried out, and the at least one low-frequency working section being relatively low in the working frequency, the a least one low-frequency working section provided on the side surface of the image forming apparatus includes (i) a first low-frequency working section which is subjected to an operation carried out by a worker who is positioned in front of the image forming apparatus, (ii) a second low-frequency working section which is lower in the working frequency than the first low-frequency working section and which is subjected to an operation carried out by the worker who is positioned on a side of the image forming apparatus, and (iii) a third low-frequency working section which is lower in the working frequency than the first low-frequency working section and higher in the working frequency than the second low-frequency working section and which is subjected to an operation carried out by the worker who is positioned on the side of the image forming apparatus, the image forming apparatus has a housing whose side surface is provided with a side surface opening/closing door, the side surface opening/closing door being openable (i) at a small opening position at which the side surface opening/closing door is opened at a relatively small opening angle, (ii) at a large opening position at which the side surface opening/closing door is opened at a relatively large opening angle, and (iii) at a medium opening position at which the side surface opening/closing door is opened at an opening angle larger than the small opening angle and smaller than the large opening angle, and the operation with respect to the first low-frequency working section is carried out while the side surface opening/closing door is opened at the small opening position, the operation with respect to the second low-frequency working section is carried out while the side surface opening/closing door is opened at the large opening position, and the operation with respect to the third low-frequency working section is carried out while the side surface opening/closing door is opened at the medium opening position.

5. The image forming apparatus as set forth in claim 4, wherein the at least one high-frequency working section includes a paper output section to which printed paper is output and a paper feeding section at which paper for printing is provided, the first low-frequency working section is a section to which a toner cartridge is attached, the second low-frequency working section is a section to which the image forming unit is attached, and the third low-frequency working section is a section to which a waste toner container is attached.

* * * * *